US008821143B2

(12) United States Patent
Takahashi et al.

(10) Patent No.: US 8,821,143 B2
(45) Date of Patent: Sep. 2, 2014

(54) VANE ROTARY COMPRESSOR

(75) Inventors: Shinichi Takahashi, Tokyo (JP); Hideaki Maeyama, Tokyo (JP); Shin Sekiya, Tokyo (JP); Tatsuya Sasaki, Tokyo (JP); Raito Kawamura, Tokyo (JP); Kanichirou Sugiura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 201 days.

(21) Appl. No.: 13/592,415

(22) Filed: Aug. 23, 2012

(65) Prior Publication Data

US 2013/0084202 A1 Apr. 4, 2013

(30) Foreign Application Priority Data

Sep. 29, 2011 (JP) ..... 2011-214643

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |
| ***F04C 29/12*** | (2006.01) |
| ***F04C 23/00*** | (2006.01) |
| ***F01C 21/10*** | (2006.01) |
| ***F04C 18/356*** | (2006.01) |

(52) U.S. Cl.

CPC ..... *F01C 21/106* (2013.01); *F04C 29/126* (2013.01); *F04C 23/008* (2013.01); *F05C 2201/02* (2013.01); *F04C 18/3564* (2013.01); *F05C 2201/021* (2013.01)

USPC ..... 418/236; 418/238; 418/270

(58) Field of Classification Search

USPC ..... 418/60–63, 178–179, 235–238, 270, 418/DIG. 1; 417/295, 310, 313

See application file for complete search history.

(56) References Cited

U.S. PATENT DOCUMENTS

| | | | | | |
|---|---|---|---|---|---|
| 4,274,816 | A | * | 6/1981 | Kobayashi et al. | 418/238 |
| 5,133,652 | A | * | 7/1992 | Abe et al. | 418/178 |
| 5,135,370 | A | * | 8/1992 | Iio | 418/83 |

FOREIGN PATENT DOCUMENTS

| | | | | | |
|---|---|---|---|---|---|
| JP | 62-079986 | U | * | 5/1987 | F04C 29/00 |
| JP | 10-252675 | A | * | 9/1998 | F04C 18/344 |
| JP | A-11-125190 | | | 5/1999 | |
| JP | A-2003-120563 | | | 4/2003 | |
| JP | A-2004-156571 | | | 6/2004 | |

* cited by examiner

*Primary Examiner* — Theresa Trieu

(74) *Attorney, Agent, or Firm* — Posz Law Group, PLC

(57) ABSTRACT

In a vane rotary compressor, a discharge valve on a discharge flow channel communicates an operating chamber in a compression element with a discharge hole. The discharge valve is pushed from an opening portion of a discharge valve groove to an outer circumferential surface of a roller by a high-pressure refrigerant when pressure in an operating chamber is lower than the pressure of the high-pressure refrigerant. The discharge valve is pushed back into the discharge valve groove by the refrigerant pressure in the operating chamber when the pressure in the operating chamber is higher than the pressure of the high-pressure refrigerant. The discharge flow channel is closed by the outer circumferential surface of the discharge valve pushed out from the opening portion of the discharge valve groove and the outer circumferential surface of the roller, and opens when the discharge valve is pushed back into the discharge valve groove.

13 Claims, 14 Drawing Sheets

VANE ROTARY COMPRESSOR

BACKGROUND OF THE INVENTION

1. Field of the Invention

The present invention relates to the discharge structure of a vane rotary compressor.

2. Description of the Related Art

Recently, the use of refrigerants with low GWPs (Global Warming Potentials) has been studied for a prevention against global warming. However, many of low-GWP refrigerants are lower in operating pressure than conventional refrigerants, and hence require large circulating volumes of refrigerant in refrigeration cycles. A compressor for controlling the circulating volume of a refrigeration cycle requires a large displacement. This inevitably increases the size of a compression element portion of the compressor. In contrast to this, car air-conditioning and the like, which have increasingly used low-GWP refrigerants, use vane rotary compressors which use refrigerants with low operating pressures and can achieve space saving.

A conventional vane rotary compressor is constituted by a cylinder having an internal space, a columnar rotor which makes rotary motion in the internal space of the cylinder, a shaft which is integrated with the rotor and transfers rotational force to the rotor, and vanes which are provided on the rotor and slide inside the cylinder together with the rotation of the rotor while the distal ends of the vanes are in contact with the inner surface of the cylinder. This compressor is configured such that a refrigerant is sucked from a low-pressure space into an operating chamber formed from the cylinder, rotor, and vanes through a suction hole, and the refrigerant is compressed in the operating chamber together with the rotation of the rotor and is discharged from the operating chamber into a high-pressure space through a discharge hole.

A discharge valve formed from a plate-like valve is provided in the opening portion of the discharge hole formed on the high-pressure space side. The discharge valve operates such that when the pressure inside the operating chamber becomes equal to or higher than that in the high-pressure space, the plate-like valve opens the discharge hole due to the differential pressure between the operating chamber and the high-pressure space so as to make the operating chamber communicate with the high-pressure space, thereby discharging the compressed refrigerant into the high-pressure space. The discharge valve also operates such that when the pressure inside the operating chamber becomes equal to or lower than that in the high-pressure space, the plate-like valve closes the discharge hole due to the differential pressure between the operating chamber and the high-pressure space so as to partition the high-pressure space from the operating chamber, thereby preventing the compressed refrigerant from flowing back to the operating chamber (see, for example, patent literatures 1 and 2).

The discharge valve prevents the refrigerant from flowing back from the high-pressure space to the operating chamber. On the other hand, however, since the discharge value closes the discharge hole before all the refrigerant is discharged from the operating chamber through the discharge hole, some high-pressure refrigerant stays in the discharge hole even when the operating chamber becomes empty after the high-pressure refrigerant is discharged. For this reason, some refrigerant may flow back from the inside of the discharge hole into the operating chamber and cause a loss. In order to solve this problem, some compressors include a first discharge valve provided in the opening portion on the high-pressure space side of the discharge hole to open and close the high-pressure space and the discharge hole, and a second discharge valve provided in the discharge hole to open and close the discharge hole and the operating chamber. The first discharge valve is formed from a plate-like valve like the conventional discharge valve. The plate-like valve opens and closes the discharge hole. The second discharge valve is formed from a spherical member. The spherical member is locked to the opening portion of the discharge hole open to the operating chamber side to close the discharge hole. When the spherical member moves away from the opening portion, the discharge hole opens. This structure makes it possible to suppress the backflow of the refrigerant from the inside of the discharge hole to the operating chamber (see, for example, patent literature 3).

Patent Literature 1: Japanese Patent Application Laid-Open (JP-A) No. 11-125190 (page 2, FIG. 7)

Patent Literature 2: Japanese Patent Application Laid-Open (JP-A) No. 2003-120563 (page 2, FIG. 7)

Patent Literature 3: Japanese Patent Application Laid-Open (JP-A) No. 2004-156571 (pages 5 to 8, FIGS. 2 and 3)

SUMMARY OF THE INVENTION

In the conventional vane rotary compressor, when the refrigerant is discharged from the operating chamber through the discharge hole, the discharge valve closes the discharge hole before all the refrigerant is discharged. For this reason, even when the operating chamber becomes empty after the high-pressure refrigerant is discharged, some high-pressure refrigerant stays inside the discharge hole. That is, the volume of the discharge hole becomes a dead volume in which a high-pressure refrigerant which cannot be discharged into the high-pressure space stays. If, therefore, after discharge operation, the discharge hole, which is the dead volume, communicates with the operating chamber which performs the next discharge operation, since the next operating chamber is in the compression phase, the pressure of the refrigerant in the operating chamber will not have risen yet. As a consequence, the high-pressure refrigerant staying in the discharge hole flows back into the operating chamber communicating with the discharge hole, and is re-expanded and re-compressed. That is, the high-pressure refrigerant staying in the dead volume causes a re-expansion loss, resulting in a deterioration in efficiency with an increase in input.

Even if the communication length from the cylinder outer surface of the discharge hole to the inner surface is decreased to reduce the dead volume, since a high-pressure gas is generated in the operating chamber, the cylinder needs to have a predetermined thickness to maintain its strength. This makes it impossible to decrease the communication length from the cylinder outer surface of the discharge hole to the inner surface. In addition, if the dead volume is reduced by decreasing the diameter of the discharge hole, the flow channel resistance of the high-pressure refrigerant passing through the discharge hole increases, resulting in a deterioration in efficiency. This makes it impossible to decrease the diameter of the discharge hole. That is, there is a problem in terms of the internal volume of the discharge hole.

If the second discharge valve is provided as a countermeasure against a dead volume as in patent literature 3, the second discharge valve requires an extra force corresponding to the mass of the spherical member to open the valve. That is, since the spherical member is pressed from the discharge hole side to the lock portion of the opening portion on the operating chamber side due to the pressure inside the high-pressure space or the pressure inside the discharge hole and the mass of the spherical member, the discharge hole communicates with the operating chamber when the pressure in the operating chamber becomes equal to the pressure that pushes back the spherical member. This therefore poses a problem that an extra force corresponding to the mass of the spherical member is required to open the discharge valve. In addition, reducing the mass of the spherical member will decrease the volume of the spherical member and reduce the opening portion of the cylinder inner circumferential surface which locks the spherical member. This increases the flow channel resistance of the refrigerant passing through the discharge hole, resulting in a pressure loss. It is therefore necessary to design opening/closing conditions based on the differential pressure between the operating chamber and the high-pressure space, the mass of the spherical member, and the opening area of the opening portion of the discharge hole. This undesirably complicates the design.

In addition, the spherical member has a larger diameter than the opening portion to lock the spherical member to the opening portion. For this reason, when the refrigerant is discharged from the operating chamber into the high-pressure space, the spherical member becomes an obstacle on the flow channel in the discharge hole. That is, the spherical member interferes with the refrigerant flowing in the discharge hole and becomes a flow channel resistance in the discharge hole, thus generating a large pressure loss.

Furthermore, the spherical member provided in the discharge hole freely moves in the discharge hole as the discharge valve opens. Since the range of movement of the spherical member is large, when the discharge hole is closed again, an operation delay occurs until the hole is closed. This makes it impossible to sufficiently perform refrigerant discharge operation and backflow preventing operation. It is necessary to provide the first discharge valve in the opening portion on the cylinder outer circumferential surface side of the discharge hole to compensate for the operation of the second discharge valve. That is, it is necessary to doubly provide discharge valves.

The present invention has been made to solve the above problems, and an object thereof is to obtain a high-efficiency compressor which, when discharging a compressed high-pressure refrigerant from an operating chamber in a compression element to a high-pressure space outside the compression element, prevents the high-pressure refrigerant staying on a flow channel extending from the operating chamber to the high-pressure space from flowing back into the operating chamber, in which the refrigerant is being compressed, and being re-expanded and re-compressed.

According to the present invention, there is provided a vane rotary compressor comprising a compression element which sucks a refrigerant from a low-pressure space, compresses the refrigerant, and discharges the refrigerant to a high-pressure space, the compression element comprising a cylinder which has an internal space formed by a substantially cylindrical inner circumferential surface, a roller having a substantially cylindrical outer circumferential surface which is accommodated in the internal space and makes rotary motion in the internal space, a shaft which includes the roller and transfers a rotational force to the roller, two bearings which support the shaft and close opening portions of two ends of the internal space of the cylinder, a plate-like vane which is provided on the roller, is made to protrude from the outer circumferential surface of the roller to the inner circumferential surface of the cylinder, and partitions a space formed by the outer circumferential surface of the roller, the inner circumferential surface of the cylinder, and the bearings into a plurality of operating chambers, a suction hole which is provided in the cylinder and sucks a refrigerant from the low-pressure space to the operating chamber, a discharge hole which is provided in the cylinder and discharges the refrigerant from the operating chamber to the high-pressure space, a discharge flow channel to which the discharge hole is open and which is formed by the outer circumferential surface of the roller, the inner circumferential surface of the cylinder, and the bearings and communicates with the operating chamber, a discharge valve groove which is provided in the cylinder and has an opening portion in the inner circumferential surface of the cylinder which forms the discharge flow channel, a discharge valve back pressure flow channel which makes the discharge valve groove communicate with the high-pressure space and introduces a high-pressure refrigerant from the high-pressure space, and a discharge valve which is accommodated in the discharge valve groove so as to be reciprocally slidable, is pushed out from the opening portion of the discharge valve groove to the outer circumferential surface of the roller by the high-pressure refrigerant when a refrigerant pressure in the operating chamber is lower than a pressure of the high-pressure refrigerant, and is pushed back into the discharge valve groove by the refrigerant pressure in the operating chamber when the refrigerant pressure in the operating chamber is higher than the pressure of the high-pressure refrigerant, wherein the discharge flow channel is closed by the outer circumferential surface of the discharge valve pushed out from the opening portion of the discharge valve groove and the outer circumferential surface of the roller, and is opened when the discharge valve is pushed back to the discharge valve groove.

The vane rotary compressor according to the present invention includes the discharge valve which is pushed out from the opening portion of the discharge valve groove to the outer circumferential surface of the roller by the high-pressure refrigerant when the refrigerant pressure within the operating chamber on the discharge flow channel which makes the operating chamber within the compression element communicate with the discharge hole is lower than the pressure of the high-pressure refrigerant, and is pushed back into the discharge valve groove by the refrigerant pressure within the operating chamber when the refrigerant pressure within the operating chamber is higher than the pressure of the high-pressure refrigerant. The discharge flow channel is closed by the outer circumferential surface of the discharge valve pushed out from the opening portion of the discharge valve groove and the outer circumferential surface of the roller and the discharge valve opens by being pushed back into the discharge valve groove. Therefore, when the compressed high-pressure refrigerant is discharged from the operating chamber within the compression element into the high-pressure space outside the compression element, it is possible to prevent the high-pressure refrigerant staying on the flow channel extending from the operating chamber to the high-pressure space from flowing back into the operating chamber, in which the refrigerant is being compressed, and being re-expanded and re-compressed.

DETAILED DESCRIPTION OF THE PREFERRED EMBODIMENTS

First Embodiment

Figure 1:
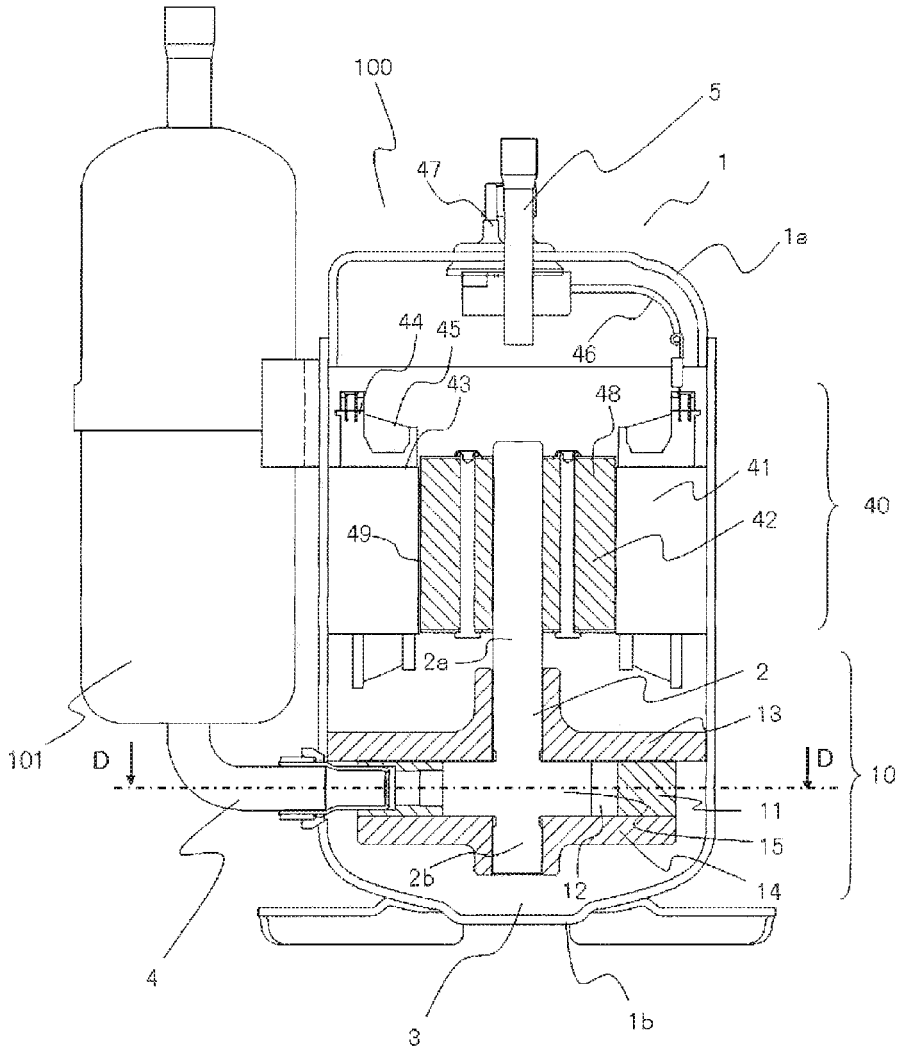
FIG. 1 is a longitudinal sectional view of a vane rotary compressor according to a first embodiment of the present invention.
Figure 2:
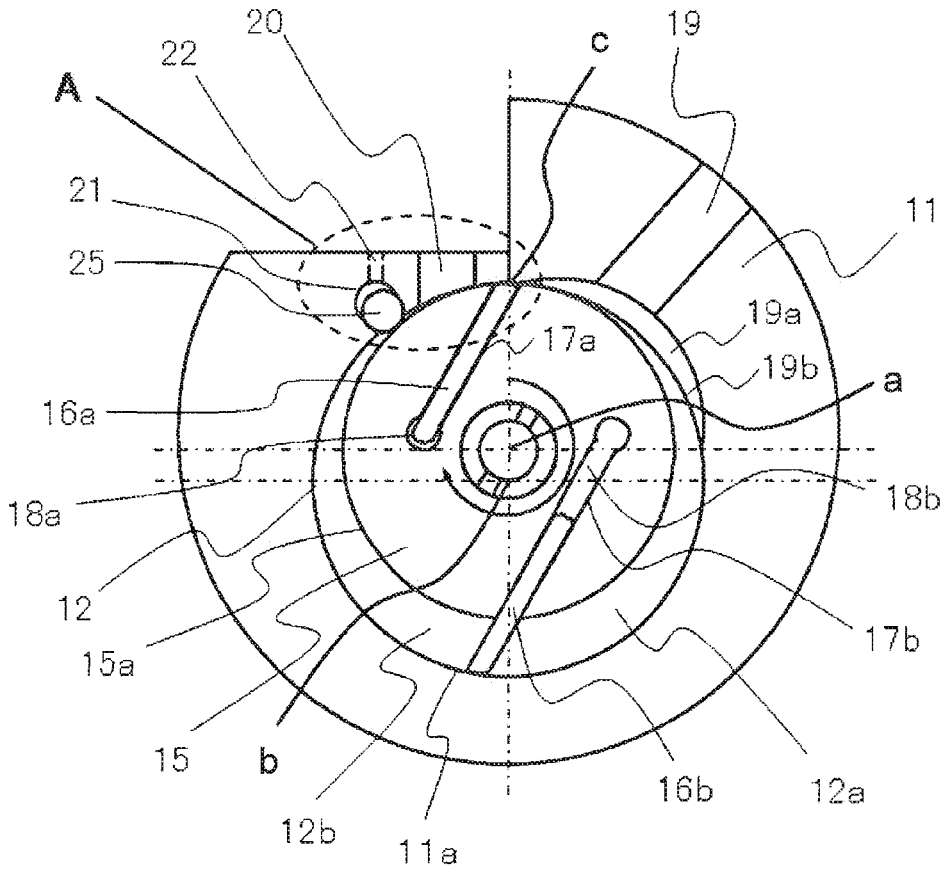
FIG. 2 is a transverse sectional view of a compression element portion of the vane rotary compressor according to the first embodiment of the present invention.
Figure 3:
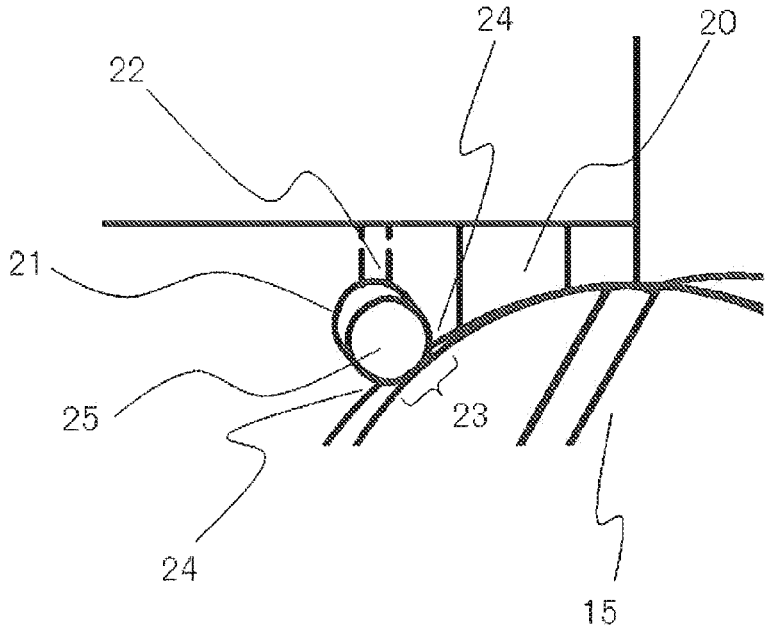
FIG. 3 is a partial enlarged view of a portion around a discharge valve of the vane rotary compressor according to the first embodiment of the present invention.
Figure 4:
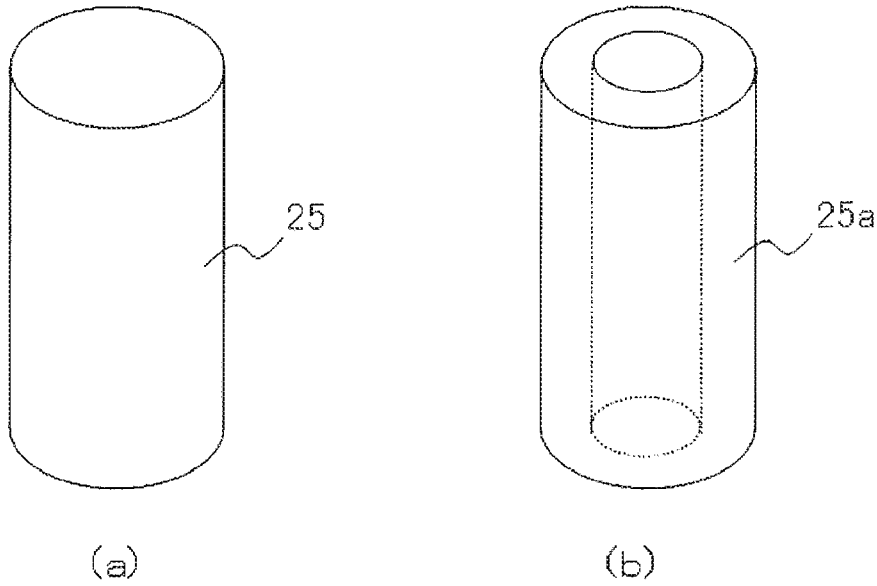
FIGS. 4A and 4B are perspective views of the discharge valve of the vane rotary compressor according to the first embodiment of the present invention.

FIG. 1 is a longitudinal sectional view of an overall vane rotary compressor according to the present invention. FIG. 2 is a transverse sectional view of the compression element portion taken along a line D-D of the vane rotary compressor shown in FIG. 1. FIG. 3 is a partial enlarged view of a portion around the discharge valve of the compression element portion shown in FIG. 2. FIGS. 4A and 4B are perspective views of the discharge valve shown in FIG. 3.

FIG. 1 illustrates the overall arrangement of the hermetic type vane rotary compressor.

A vane rotary compressor 100 in FIG. 1 is formed by arranging, in a closed vessel 1 constituted by an upper vessel 1*a* and a lower vessel 1*b*, a compression element 10 which compresses a refrigerant and a motor element 40 which drives the compression element 10. The compression element 10 is coupled to the motor element 40 through a rotating shaft, i.e., a shaft 2. The compression element 10 is disposed in the lower portion of the closed vessel 1, and the motor element 40 is disposed in the upper portion of the closed vessel 1.

By means of this arrangement, the compression element 10 driven by the motor element 40 directly sucks a refrigerant from the outside of the closed vessel 1, compresses the refrigerant, and discharges the refrigerant to the outside of the closed vessel 1 through the closed vessel 1.

FIG. 1 shows an example in which a high-pressure atmosphere is set in the closed vessel 1. However, a low-pressure atmosphere may be set in the closed vessel 1. That is, the compression element 10 may suck a refrigerant from the outside of the closed vessel 1 through the closed vessel 1, compresses the refrigerant, and directly discharges the refrigerant from the compression element 10 to the outside of the closed vessel 1. Although this embodiment may be applied to other arrangements such as an engine-driven arrangement, the following will exemplify a closed vessel type arrangement which is widely used in domestic and industrial applications.

FIG. 1 shows an arrangement in which the compression element 10 and the motor element 40 are respectively disposed in the lower and upper portions of the closed vessel 1. However, the compression element 10 and the motor element 40 may be disposed side by side or may be respectively disposed in the upper and lower portions of the closed vessel 1.

A refrigerating machine oil 3 is reserved in the bottom portion of the closed vessel 1 and is fed to each sliding portion of the compression element 10 by an oil feeding mechanism provided in the lower portion of the compression element 10. This ensures the mechanical lubricating action of the compression element 10.

An accumulator 101 for gas-liquid separation is provided outside the closed vessel 1. The accumulator 101 is connected to the compression element 10 in the closed vessel 1 through a suction pipe 4. The compression element 10 sucks a refrigerant from the accumulator 101. A discharge pipe 5 is provided in the upper portion of the closed vessel 1. The refrigerant compressed by the compression element 10 is discharged out of the closed vessel 1 through the discharge pipe 5. Note that the refrigerant discharged out of the closed vessel 1 circulates in a refrigerant circuit provided outside the closed vessel 1 and returns to the compression element 10 through the accumulator 101.

Figure 5:
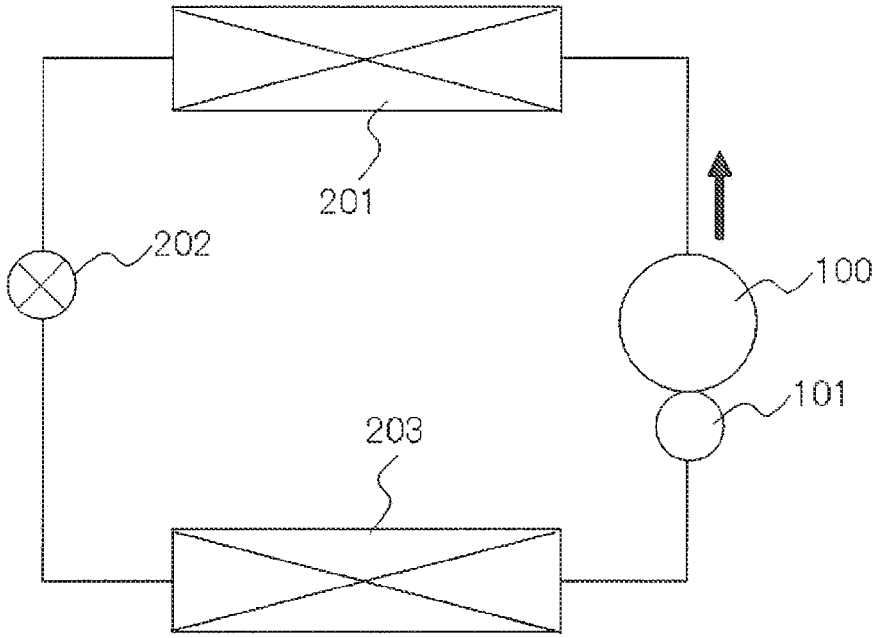
FIG. 5 is a refrigerant circuit diagram according to the first embodiment of the present invention.
Figure 6:
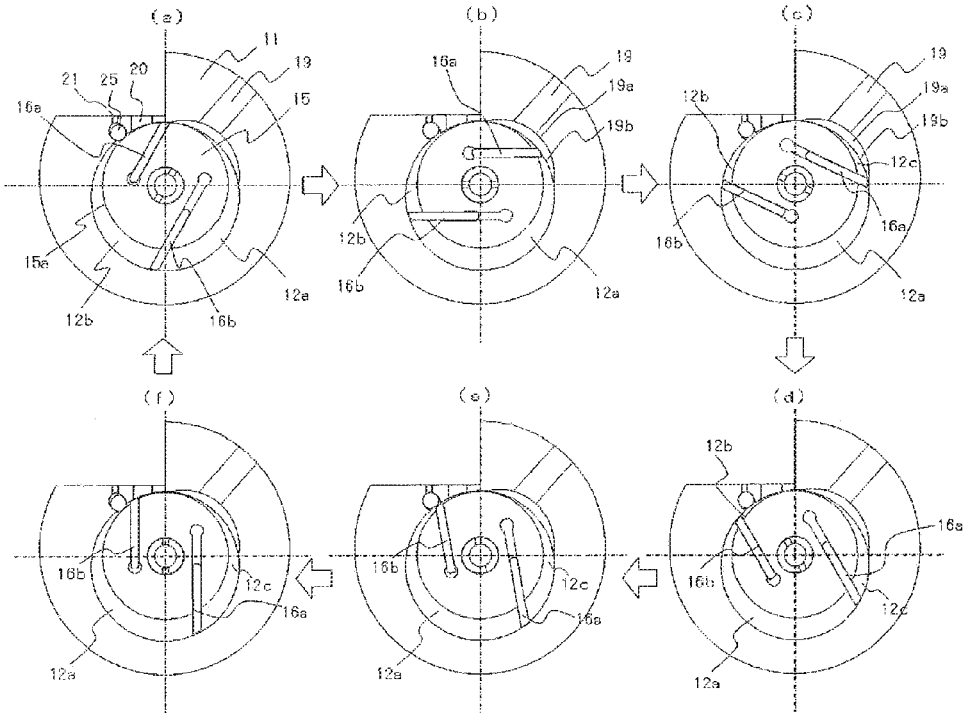
FIGS. 6A to 6F are views showing the compression process of the vane rotary compressor according to the first embodiment of the present invention.

FIG. 5 shows an example of the refrigerant circuit of an air conditioner equipped with the compressor 100. The refrigerant circuit in FIG. 5 is formed by annularly connecting, through pipes, the compressor 100 which compresses the refrigerant, the accumulator 101, a condenser 201 which condenses the refrigerant, a pressure reducer 202 which reduces the pressure of the refrigerant, and an evaporator 203 which evaporates the refrigerant. The high-pressure refrigerant compressed by the compressor 100 is sent to the condenser 201. The refrigerant sent to the condenser 201 is heat-exchanged with air and condensed by the condenser 201. The resultant refrigerant is sent to the pressure reducer 202. The pressure reducer 202 then reduces the pressure of the refrigerant sent to it. The resultant low-pressure refrigerant is sent to the evaporator 203. The evaporator 203 further heat-exchanges the refrigerant sent to it with air and evaporates the refrigerant. The resultant refrigerant returns to the compressor 100 again through the accumulator 101. At this time, the condenser 201 performs heat exchange by transferring heat to the air, and the evaporator 203 receives heat from the air. If the condenser 201 and the evaporator 203 are respectively provided indoor and outdoor, the room is heated. If the condenser 201 and the evaporator 203 are respectively provided outdoor and indoor, the room is cooled. A four-way valve (not shown) and the like can change the circulating direction in these operations. This allows to switch between the heating and cooling operations.

The motor element 40 will be described next. The motor element 40 is, for example, a brushless DC motor, which is constituted by a stator 41 fixed to the inner circumference of the closed vessel 1 and a rotor 42 disposed inside the stator 41.

The stator 41 is constituted by a stator core 43, an insulating member 44, and a coil 45. A lead wire 46 is connected to the coil 45. The lead wire 46 is connected to a glass terminal 47 provided in the closed vessel 1. An external power supply which energizes the coil 45 through the lead wire 46 is connected to the glass terminal 47. The coil 45 is an assembly of windings wound around a plurality of teeth provided on the stator core 43 through the insulating member 44 in the rotational axis direction, i.e., the vertical direction. The winding portions of the coil 45 are accommodated in the slots formed between the teeth with almost no spaces. With this arrangement, when the external power supply energizes the coil 45, the coil 45 generates magnetic fluxes to generate a plurality of magnetic poles on the stator core 43.

Note that the stator core 43 is formed by stacking core sheets punched out from a thin magnetic steel sheet, and is fixed to the closed vessel 1 by shrinkage fitting.

The interior of the closed vessel 1 serves as a flow channel in which a refrigerant circulates. The motor element portion is exposed to this refrigerant flow. The external power supply generates a commercial power voltage or a high voltage equal to or higher than the commercial power voltage to the coil 45. Therefore, a copper wire or aluminum wire coated with an insulating film is used as the coil 45, and the insulating member is formed from PET (polyethylene terephthalate), PBT (polybutylene terephthalate), or the like.

The rotor 42 is provided with a rotor core 48 formed by stacking core sheets punched out from a thin magnetic steel sheet as in the case of the stator 41 and a magnet insertion hole near the outer circumferential side surface of the rotor core 48. A permanent magnet such as a ferrite magnet or rare-earth magnet is inserted in the magnet insertion hole to form magnetic poles on the rotor 42.

Note that a permanent magnet may be formed by using a ferrite magnet or rare-earth magnet singly or by using two or more types of ferrite magnets or rare-earth magnets together. According to the above description, the magnet insertion hole is provided near the outer circumferential side surface of the rotor core 48. However, this hole may be provided on the inner circumferential side of the rotor core 48 a predetermined distance away from the outer circumferential side surface of the rotor core 48 to regulate the magnetic force of the permanent magnet. Alternatively, the permanent magnet may be bonded to the outer circumferential surface of the rotor core 48 without providing any magnet insertion hole in the rotor core 48.

End plates or balance weights which close the magnet insertion hole are fixed to the two end faces of the rotor core 48 to prevent the permanent magnet from flying away. In the compression element 10, the differences between the rotation torques required for the respective processes such as suction, compression, and discharge processes cause rotation torque displacement. The balance weights are mounted on the two end faces to correct rotary motion irregularity of the rotor 42 caused by rotation torque displacement, and are mounted only when required. Note that FIG. 1 shows a case in which no balance weights are mounted.

A shaft hole having an inner diameter smaller than the outer diameter of the shaft 2 is provided in the center of the rotor core 48. Due to the shaft 2 being fitted in the shaft hole by means of shrinkage fitting, the rotor core 48 is fixed to the shaft 2. This allows the rotor 42 and the shaft 2 rotate together. The rotational force of the motor element 40 is transferred through the shaft 2.

A gap in the radial direction, called an air gap 49, is provided between the stator 41 and the rotor 42 almost uniformly throughout the whole circumference. Since magnetic fluxes are transferred from the stator 41 to the rotor 42 through the air gap 49, broadening the air gap 49 will cause a decrease in the efficiency of the motor element 40. For this reason, the air gap 49 is minimized. At the same time, since the air gap 49 also serves as a flow channel along which the refrigerant discharged from the compression element 10 flows toward the discharge pipe 5, excessively narrowing the air gap 49 will make it difficult for the high-pressure refrigerant discharged from the compression element 10 below the motor element 40 to flow into the discharge pipe 5 in the upper portion of the closed vessel 1. In order to compensate for this, the rotor 42 may be provided with a plurality of air holes communicating with the rotor 42 in the axial direction.

Due to the above arrangement, the motor element 40 rotates the rotor 42 with the magnetic fluxes generated by the rotor 42 interacting with the magnetic fluxes generated by the coil 45 of the stator 41, and the rotational force of the motor element 40 is transferred to the shaft 2.

Although the motor element 40 has been exemplified as a brushless DC motor, this element may be, for example, an induction motor using no permanent magnet for the rotor 42. The arrangement of the stator of an induction motor is almost the same as that of a brushless DC motor. However, the rotor of the induction motor is provided with a secondary coil instead of a permanent magnet. The induction motor rotates as the result of the induction of magnetic fluxes by the coil on the stator side to the secondary coil.

In general, a larger number of brushless DC motors, which generate magnetic fluxes by using permanent magnets without producing any electric effects on the rotor side, are used for household. This is because a brushless DC motor generates no loss by the electric circuit on the rotor side, and accordingly is more efficient.

In addition, a brushless DC motor cannot use a commercial power supply in direct connection as an external power supply, and hence needs an external power supply having a function of switching the direction of a magnetic flux generated by the coil 45 on the stator 41 side, i.e., the flowing direction of a current, in accordance with the direction of a magnetic flux generated by permanent magnet of the rotor 42, i.e., the N and S poles. That is, switching the energizing direction of the external power supply will cause switching of the direction of a magnetic flux on the stator 41 side, thereby repelling or attracting the permanent magnet of the rotor 42 and rotating the rotor 42. In general, therefore, an external power supply uses a frequency converter which can change the energizing direction, i.e., can change the frequency of a voltage to be applied or a current to be supplied and its value. A frequency converter is generally a device formed from semiconductors such as transistors. This device can freely change the speed of switching the direction of a voltage to be applied or a current to be supplied and the speed of repeating this switching operation, and also can freely control the number of revolutions, i.e., the rotation speed, of the brushless DC motor, and generated torque by increasing/decreasing the voltage to be applied so as to increase/decrease the current to be supplied. This arrangement allows finer speed regulation and implements more efficient compressor operation.

According to the above description, a variable frequency, variable voltage external power supply is applied to the brushless DC motor. However, this power supply may be applied to an induction motor. Performing variable frequency/variable voltage control on the induction motor allows fine speed regulation and can implement more efficient compressor operation.

If an induction motor requires no speed control or torque control, a constant frequency, constant voltage power supply may be used as an external power supply.

The compression element 10 will be described next. The compression element 10 is constituted by a cylinder 11 having an almost cylindrical inner circumferential surface, upper and lower bearings 13 and 14 which close the two end opening portions of the almost cylindrical inner circumferential surface of the cylinder 11 in the axial direction, the shaft 2 supported by the upper and lower bearings 13 and 14, a roller 15 provided on the shaft 2, and vanes 16*a* and 16*b* provided on the roller 15. In addition, the almost cylindrical inner circumferential surface of the cylinder 11 and the upper and lower bearings 13 and 14 form a cylinder chamber 12 in an almost cylindrical shape. The roller 15 is accommodated in the cylinder chamber 12. Furthermore, the cylinder 11, the upper bearing 13, the lower bearing 14, the roller 15, and the vanes 16*a* and 16*b* form an operating chamber in the cylinder chamber 12.

The compression element 10 will be described in detail with reference to FIG. 2. The cylinder 11 has inside thereof an almost cylindrical inner circumferential surface 11*a*. The upper bearing 13 closes one of the two end opening portions of the inner circumferential surface 11*a* which is located on the upper side. The lower bearing 14 closes one of the two end opening portions which is located on the lower side. The inner circumferential surface 11*a*, the upper bearing 13, and the lower bearing 14 define the cylinder chamber 12 in the cylinder 11.

The upper and lower bearings 13 and 14 each have an almost T-shaped cross section and an almost disk-like portion in contact with the cylinder 11. An end face of each bearing which is located on the cylinder 11 side is almost flat and is fixed to the cylinder 11 with a bolt.

The upper bearing 13 is fixed by welding to the inner circumferential surface of the closed vessel 1, and the overall compression element 10 is fixed and supported on the closed vessel 1. Note that the portion to be fixed may be the lower bearing 14 or the cylinder 11.

As shown in FIG. 1, the roller 15 is fitted on or integrally molded with the central portion of the shaft 2 in the axial direction so as to be coaxial with the central axis of the shaft 2. Rotating shaft portions 2*a* and 2*b* of the shaft 2 are formed on the two sides of the roller 15. The rotating shaft portions 2*a* and 2*b* of the shaft 2 are rotatably supported by the upper and lower bearings 13 and 14.

The cylinder chamber 12 accommodates the almost cylindrical roller 15 which is provided on the shaft 2 and smaller in volume than the cylinder chamber 12. The shaft 2 located at the rotation center (a) of the roller 15 is provided at a position offset from the center (b) of the almost cylindrical cylinder chamber 12, and an almost cylindrical outer circumferential surface 15*a* of the roller 15 and the cylinder inner circumferential surface 11*a* have a nearest neighbor point (c). The shaft 2 rotates and slides the roller 15. At the nearest neighbor point (c), the outer circumferential surface 15*a* and the inner circumferential surface 11*a* are not in contact and form a small gap by keeping the distance between them. The small gap is sealed and closed with the refrigerating machine oil 3 supplied to the compression element 10. Note that the outer circumferential surface 15*a* and the inner circumferential surface 11*a* form the cylinder chamber 12 and the operating chamber formed in the cylinder chamber 12.

As shown in FIG. 2, the roller 15 is provided with vane grooves 17*a* and 17*b* having opening portions in the roller outer circumferential surface 15*a*. The vanes 16*a* and 16*b*, each having an almost rectangular parallelepiped shape (plate-like shape), are slidably provided in the vane grooves 17*a* and 17*b* so as to protrude from the opening portions of the vane grooves 17*a* and 17*b* to the inner circumferential surface 11*a*. The distal ends of the vanes 16*a* and 16*b* which protrude from the opening portions are in contact with the cylinder inner circumferential surface 11*a*. To partition the cylinder chamber 12, the lengths of the vanes 16*a* and 16*b* in the axial direction are set to be almost equal to the length of the roller 15 or cylinder 11 in the axial direction. In addition, the vane grooves 17*a* and 17*b* are also formed as grooves extending throughout the total length of the roller 15 in the axial direction to accommodate the vanes 16*a* and 16*b*.

Vane back pressure spaces 18*a* and 18*b* formed by the vanes 16*a* and 16*b* and the vane grooves 17*a* and 17*b* are provided on the opposite sides of the vane grooves 17*a* and 17*b* to the opening portions. The vane back pressure spaces 18*a* and 18*b* communicate with a vane back pressure flow channel (not shown) provided in at least one of the upper bearing 13 and the lower bearing 14. The vane back pressure flow channel makes the vane back pressure spaces 18*a* and 18*b* communicate with the high-pressure space of the closed vessel 1, and introduces the high-pressure refrigerant in the high-pressure space into the vane back pressure spaces 18*a* and 18*b*. The high-pressure refrigerant introduced into the vane back pressure spaces 18*a* and 18*b* pushes the vanes 16*a* and 16*b* from the inside of the vane grooves 17*a* and 17*b* to the outside of the vane grooves 17*a* and 17*b*, i.e., outside the roller 15. This does not make the vanes 16*a* and 16*b* come off from the vane grooves 17*a* and 17*b* but makes the distal ends of the vanes 16*a* and 16*b* come into contact with the almost cylindrical inner circumferential surface 11*a*.

The vanes 16*a* and 16*b* each have an almost rectangular parallelepiped plate-like shape. Each vane distal end portion located on the cylinder inner circumferential surface 11*a* side is formed into an arc shape on the outside. The radius of this arc shape is smaller than the radius of the almost cylindrical inner circumferential surface of the cylinder 11. Due to this structure, the distal ends of the vanes 16*a* and 16*b* come into contact with the almost cylindrical inner circumferential surface 11*a* at one point in the radial direction and on a line in the axial direction, and generation of a friction is suppressed.

With this arrangement, the vanes 16*a* and 16*b* come into contact with the cylinder inner circumferential surface 11*a* to partition the operating chamber formed in the cylinder chamber 12 into an operating chamber (suction chamber) 12*a* on the suction side and an operating chamber (compression chamber) 12*b* on the discharge side. Accompanying the rotation of the roller 15, the vanes 16*a* and 16*b* move along the cylinder inner circumferential surface 11*a* in the cylinder chamber 12 while the distal ends of the vanes 16*a* and 16*b* are in contact with the cylinder inner circumferential surface 11*a*. Note that since the rotation center (a) of the roller 15 is offset from the center (b) of the cylinder 11, the distance between the roller outer circumferential surface 15*a* and the cylinder inner circumferential surface 11*a* which face each other varies depending on the position of the inner circumferential surface 11*a*. It is therefore necessary to change the amounts, i.e., the length, by which the vanes 16*a* and 16*b* are pushed out from the roller 15, in accordance with the rotation of the roller 15. For this reason, the refrigerant pressures in the vane back pressure spaces 18*a* and 18*b* control the lengths by which the vanes 16*a* and 16*b* are pushed out from the vane grooves 17*a* and 17*b*, together with the rotation of the roller 15. This makes the vanes 16*a* and 16*b* reciprocally slide inside the vane grooves 17*a* and 17*b*.

Note that owing to this arrangement of the vanes 16*a* and 16*b*, it is preferable to use a refrigerant having a low operating pressure, by which the forces acting from the operating chambers 12*a* and 12*b* onto the vanes 16*a* and 16*b* are small, and a standard boiling point of not less than −45° C. It is possible to use such a low pressure type of refrigerant without positing any problem in terms of the strength of the vanes 16*a* and 16*b* and vane grooves 17*a* and 17*b*.

In addition, in some case, the vane back pressure flow channel is provided with a back pressure regulating mechanism which regulates the refrigerant pressures in the vane back pressure spaces 18*a* and 18*b*, thereby regulating the forces with which the vanes 16*a* and 16*b* come into contact with the cylinder inner circumferential surface 11*a*.

In the following description, the positions at which the vanes 16*a* and 16*b* come into contact with the cylinder inner circumferential surface 11*a* are defined with the nearest neighbor point (c) between the almost cylindrical outer circumferential surface 15*a* and the almost cylindrical inner circumferential surface 11*a* being 0°, and one clockwise rotation along the rotating direction of the roller 15 in FIG. 2 corresponding to 360°. For example, the position at which the vane 16*a* comes into contact with the cylinder inner circumferential surface 11*a* is defined by 0°, and the position at which the vane 16*b* comes into contact with the cylinder inner circumferential surface 11*a* is defined by 180°.

In the state shown in FIG. 2, the distal end of the vane 16*a* is located near 0°, and the distance between the roller outer circumferential surface 15*a* near 0° and the cylinder inner circumferential surface 11*a* which face each other is the shortest. For this reason, the distal end of the vane 16*a* is located at almost the same position as that of the roller outer circumferential surface 15*a*, i.e., the overall vane 16*a* is accommodated in the vane groove 17*a*. Likewise, the vane 16*a* is located near 180°, and the distance between the roller outer circumferential surface 15*a* near 180° and the cylinder inner circumferential surface 11*a*, which face each other, is the longest. For this reason, the distal end of the vane 16*b* is pushed to the maximum from the roller outer circumferential surface 15*a*, i.e., the vane 16*b* is pushed to the maximum from the vane groove 17*b*.

The cylinder 11 is provided with a suction hole 19 and a discharge hole 20 which are located on the two sides of the nearest neighbor point (c) between the roller outer circumferential surface 15*a* and the cylinder inner circumferential surface 11*a*. One opening of the suction hole 19 communicates with the suction pipe 4, and the other opening is open to the cylinder inner circumferential surface 11*a*, i.e., the cylinder chamber 12. Likewise, one opening of the discharge hole 20 is open to the cylinder inner circumferential surface 11*a*, i.e., the cylinder chamber 12, and the other opening is open to the outer surface of the cylinder 11, i.e., the interior of the closed vessel 1.

The opening portion of the suction hole 19 which is located on the cylinder inner circumferential surface 11*a* side is provided with an intra-cylinder suction space 19*a* communicating with the opening portion. The intra-cylinder suction space 19*a* is a groove-like space in the radial direction which is provided in the cylinder 11, and makes the opening portion of the suction hole 19 which is located on the cylinder inner circumferential surface 11*a* side communicate with the cylinder chamber 12. Due to this arrangement, the intra-cylinder suction space 19*a* has a function of broadening the flow channel extending from the suction hole 19 to the cylinder chamber 12.

The refrigerant discharged from the discharge hole 20 passes upward through the hole provided in the upper bearing 13 or the gap between the closed vessel 1 and the upper bearing 13 and flows toward the discharge pipe 5.

The cylinder 11 is provided with a discharge valve groove 21 and a discharge valve back pressure flow channel 22. These components will be described in detail with reference to FIG. 3. FIG. 3 is an enlarged view of a portion A in FIG. 2.

The cylinder 11 is provided with the discharge valve groove 21 having an opening portion in the cylinder inner circumferential surface 11*a*, i.e., the cylinder chamber 12. The discharge valve groove 21 is disposed in the cylinder 11 serving as the discharge flow channel which is located in the vicinity of the discharge hole 20 and makes the operating chamber 12*b* communicate with the discharge hole 20, and along which a refrigerant flows from the operating chamber 12*b* to the discharge hole 20. That is, the discharge valve groove 21 is disposed on the opposite side of the discharge hole 20 to the side where the nearest neighbor point (c) is disposed. With this structure, the discharge valve groove 21 is disposed before the discharge hole 20 in the traveling direction in which the distal end of the vane 16*a* or 16*b* slides and moves, on the cylinder inner circumferential surface 11*a*, from the nearest neighbor point (c) through the suction hole 19, on the upstream side where the refrigerant flows toward the discharge hole 20. Note that the discharge flow channel along which the refrigerant flows from the operating chamber 12*b* to the discharge hole 20 is the flow channel formed from the operating chamber 12*b* to the discharge hole 20 between the cylinder inner circumferential surface 11*a* or the opening portion of the discharge valve groove 21 and the outer circumferential surface 15*a*. Note that the upper and lower ends of the discharge flow channel are also closed by the upper bearing 13 and the lower bearing 14, respectively.

The discharge valve groove 21 is an almost cylindrical groove having an almost circular cross section and extending through in the same direction as the axial direction of the cylinder chamber 12, i.e., the axial direction of the shaft 2.

Note that the discharge valve groove 21 is provided such that the axial direction of the discharge valve groove 21 is almost parallel to the axial direction of the cylinder chamber 12. A discharge valve groove opening portion 23 open to the cylinder chamber 12 is provided in the discharge valve groove 21 throughout the total length of the cylinder inner circumferential surface 11*a* in the axial direction. In addition, the discharge valve groove opening portion 23 is provided with a discharge valve groove receiving portion 24.

A discharge valve 25 is inserted into the discharge valve groove 21 so as to be freely pivotal and reciprocally movable. As shown in FIG. 4A, the discharge valve 25 has an almost columnar shape as a whole, whose length in the axis direction is almost equal to that of the discharge valve groove 21 and whose sectional area in a direction perpendicular to the axial direction is slightly smaller than that of the discharge valve groove 21. The discharge valve 25 is large enough to accommodate the whole discharge valve groove 21. In addition, the discharge valve groove 21 is structured such that when the discharge valve 25 is pushed to the discharge valve groove opening portion 23 side, the discharge valve groove receiving portion 24 locks the discharge valve 25 while a portion of the discharge valve 25 protrudes to the cylinder chamber 12. However, since the discharge valve groove opening portion 23 is smaller than the diameter of the discharge valve 25, the discharge valve 25 does not come off from the discharge valve groove 21. In addition, in order to improve the responsiveness of reciprocal movement inside the discharge valve groove 21, the range of movement of the discharge valve 25 relative to the discharge valve groove 21 is narrowed by only slightly broadening the discharge valve groove 21 relative to the discharge valve 25.

The discharge valve 25 and the discharge valve groove 21 are provided so as to direct the reciprocal movement of the discharge valve 25 to the normal direction of the outer circumferential surface 15*a* of the almost cylindrical roller, i.e., the shaft 2 as the center of the roller 15.

The discharge valve 25 pushed out by the cylinder chamber 12 partitions the cylinder chamber 12 by the almost cylindrical outer circumferential surface of the discharge valve 25 and the roller outer circumferential surface 15*a*. Note however that the outer circumferential surface of the discharge valve 25 and the roller outer circumferential surface 15*a* do not come into contact with each other and keep a predetermined distance therebetween. That is, a small gaps is formed between the outer circumferential surface of the discharge valve 25 and the roller outer circumferential surface 15*a*. Since the small gap is sealed and closed with the refrigerating machine oil 3 supplied to the compression element 10, the outer circumferential surface of the discharge valve 25 and the roller outer circumferential surface 15*a* can partition the cylinder chamber 12. To partition the cylinder chamber 12, the length of the discharge valve 25 is also set to be equal to the length of the cylinder 11 or roller 15 in the axial direction, and the discharge valve groove 21 and the discharge valve groove opening portion 23 are formed throughout the total length of the cylinder 11 in the axial direction.

FIG. 4A shows the discharge valve 25 which has a solid shape in an almost columnar shape. However, a discharge valve 25*a* shown in FIG. 4B may be used, which has a hollow shape in an almost cylindrical shape. The discharge valve 25*a* in the almost cylindrical shape has a smaller mass and hence requires a smaller force for movement thereof. In addition, the end faces of the discharge valve 25, the upper bearing 13, and the lower bearing 14 serve as sliding portions to generate friction. The discharge valve 25 has an almost columnar shape. In contrast, the discharge valve 25*a* has an almost cylindrical shape, and hence the contact areas between the end faces of the discharge valve 25*a*, the upper bearing 13, and the lower bearing 14 are smaller. The friction generated by them is therefore small. Consequently, the sliding resistance of the discharge valve 25*a* is smaller, and the discharge valve 25*a* can be moved with a small force. This can improve the responsiveness of reciprocal movement inside the discharge valve groove 21.

In addition, the discharge valve 25*a* need not have a hollow body, and the hollow portion may be filled with a different material. It is possible to regulate the mass of the discharge valve 25*a* and the force required to move the discharge valve 25*a* in accordance with a material with which the hollow portion is filled or the amount of material. That is, it is possible to regulate the responsiveness of the discharge valve 25*a* and conditions for movement.

The weight of the discharge valve 25 or 25*a* can be further reduced by using a lightweight metal material such as aluminum or titanium or an alloy material such as an aluminum base alloy or titanium base alloy. This can further reduce the inertia force and improve the responsiveness of reciprocal movement of the discharge valve 25 or 25*a* inside the discharge valve groove 21.

In addition, since the discharge valve 25 reciprocally moves inside the discharge valve groove 21, it is possible to reduce abrasion, make it difficult to produce abrasion powder, and prolong the service life of the compressor by forming an abrasion-resistant coating on the surface of at least one of the discharge valve 25 and the discharge valve groove 21.

The cylinder 11 in FIG. 3 is provided with the discharge valve back pressure flow channel 22 which makes the high-pressure space in the closed vessel 1 outside the cylinder 11 communicate with the discharge valve groove 21. The discharge valve back pressure flow channel 22 introduces the high-pressure refrigerant in the high-pressure space into the discharge valve groove 21. The high-pressure refrigerant introduced by the discharge valve back pressure flow channel 22 acts to push the discharge valve 25 into the cylinder chamber 12. The pushed discharge valve 25 closes the discharge flow channel along which the refrigerant flows from the operating chamber 12*b* in the cylinder chamber 12 to the discharge hole 20. Therefore, the discharge hole 20 always communicates with the high-pressure space, and a high-pressure atmosphere is set in the discharge hole 20.

Note that when the refrigerant pressure in the operating chamber 12*b* becomes a predetermined pressure, the discharge valve 25 is pushed back into the discharge valve groove 21 to open the discharge flow channel along which the refrigerant flows from the operating chamber 12*b* to the discharge hole 20. The relationship between the refrigerant pressure in the operating chamber 12*b* and the opening/closing movement of the discharge valve 25 will be described in detail in the description of the next operation.

Note that the discharge valve back pressure flow channel 22 may have a hole shape or groove shape. In addition, the discharge valve back pressure flow channel 22 may be formed from a plurality of hole shapes or groove shapes. It is possible to regulate the timing at which the high-pressure refrigerant flows into the discharge valve groove 21 and control the response speed of the discharge valve 25 and stress acting on the discharge valve groove receiving portion 24 depending on hole or groove shapes or the number of them.

The operation of the overall compressor will be described next.

When the compressor 100 is energized, the rotor 42 of the motor element 40 rotates to rotate the shaft 2 fitted in the rotor 42. The shaft 2 further transfers the rotational force of the roller 15 of the compression element 10 fitted on the shaft 2 to rotate the roller 15. As the roller 15 rotates, the vanes 16*a* and 16*b* provided in the vane grooves 17*a* and 17*b* of the roller 15 also move inside the cylinder chamber 12.

The high-pressure refrigerant directly flows from the back pressure regulating mechanism or the high-pressure space into the vane back pressure spaces 18*a* and 18*b* of the vanes 16*a* and 16*b* through the vane back pressure flow channel. The vanes 16*a* and 16*b* are brought into contact with the cylinder inner circumferential surface 11*a*, as shown in FIG. 2, by the internal pressures of the vane back pressure spaces 18*a* and 18*b* and the centrifugal force generated by the rotation of the roller 15. That is, the vanes 16*a* and 16*b* slide and move inside the cylinder 11 upon rotation of the roller 15 while being in contact with the cylinder inner circumferential surface 11*a*.

As shown in FIG. 2, the vanes 16*a* and 16*b* form the spaces surrounded by the cylinder inner circumferential surface 11*a* and the roller outer circumferential surface 15*a*, i.e., the operating chambers 12*a* and 12*b*. Note that the upper and lower portions of the operating chambers 12*a* and 12*b* are closed by the upper and lower bearings 13 and 14.

In the state shown in FIG. 2, the opening portion of the suction hole 19 which is located on the cylinder inner circumferential surface 11*a* side communicates with the operating chamber 12*a*, and the refrigerant flows into the operating chamber 12*a* through the suction hole 19. The roller 15 rotationally moves the vanes 16*a* and 16*b* clockwise such that they move from the nearest neighbor point (c) to the discharge hole 20 through the suction hole 19 and return to the nearest neighbor point (c) through the discharge hole 20. FIGS. 6A to 6F are diagrams showing a state in which the roller 15 rotationally moves clockwise from the state in FIG. 2. The process to be performed from the instant the vane rotary compressor 100 sucks the refrigerant to the instant the compressor 100 discharges the refrigerant will be described with reference to FIGS. 6A to 6F.

FIGS. 6A and 2 show the same state, i.e., the process in which the operating chamber 12*a* on the suction hole 19 side communicates with the suction hole 19 and sucks the refrigerant from the accumulator 101 side.

FIG. 6B shows a state in which the roller 15 has rotated clockwise from state in FIG. 6A. The vane 16*a* comes into contact with an intra-cylinder inner circumferential surface 19*b* around the suction hole 19, and hence cannot enter the intra-cylinder suction space 19*a* in the groove shape. Even when, therefore, the vane 16*a* passes through the suction hole 19, the operating chamber 12*a* keeps communicating with the suction hole 19 through the intra-cylinder suction space 19*a* and continues sucking operation.

In the state shown in FIG. 6C, the roller 15 rotates through about 90°, and the operating chamber 12*a* and the intra-cylinder suction space 19*a* are closed by the vane 16*a*. That is, the operating chamber 12*a* is formed by the cylinder inner circumferential surface 11*a*, the roller outer circumferential surface 15*a*, and the vanes 16*a* and 16*b*. The operating chamber 12*a* therefore stops communicating with the suction hole 19 and terminates the process of sucking operation. The process of compressing operation starts from this state.

Referring to FIG. 6D, the roller 15 further rotates to gradually reduce the internal volume of the operating chamber 12*a*, and compressing operation continues.

FIG. 6E shows a state in which the vane 16*b* is in contact with the discharge valve 25. FIG. 6F shows a state in which the vane 16*b* has moved to the discharge hole 20 side of the discharge valve 25. Subsequently, the operating chamber 12*a* is formed by the cylinder inner circumferential surface 11*a*, the roller outer circumferential surface 15*a*, the vane 16*a*, and the discharge valve 25.

When the roller 15 further rotates, the state shown in FIG. 6A is set. Since the operating chamber indicated by the operating chamber 12*a* in FIG. 6F is equivalent to the operating chamber 12*b* in FIG. 6A, the following description will made on the operation of the operating chamber 12*b*. Since the compressing operation progresses as the roller 15 rotates, the refrigerant pressure inside the operating chamber 12*b* in FIG. 6A rises. When this pressure becomes a predetermined pressure, i.e., a discharge pressure, the discharge valve 25 starts operating. This operation will be described in detail with reference to FIGS. 7 and 8.

Figure 7:
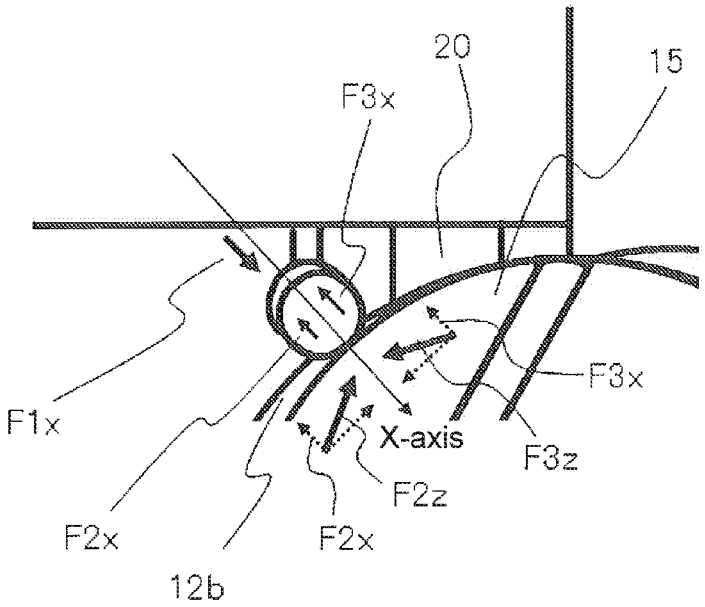
FIG. 7 is a first explanatory diagram of forces acting on the discharge valve of the vane rotary compressor according to the first embodiment of the present invention.
Figure 8:
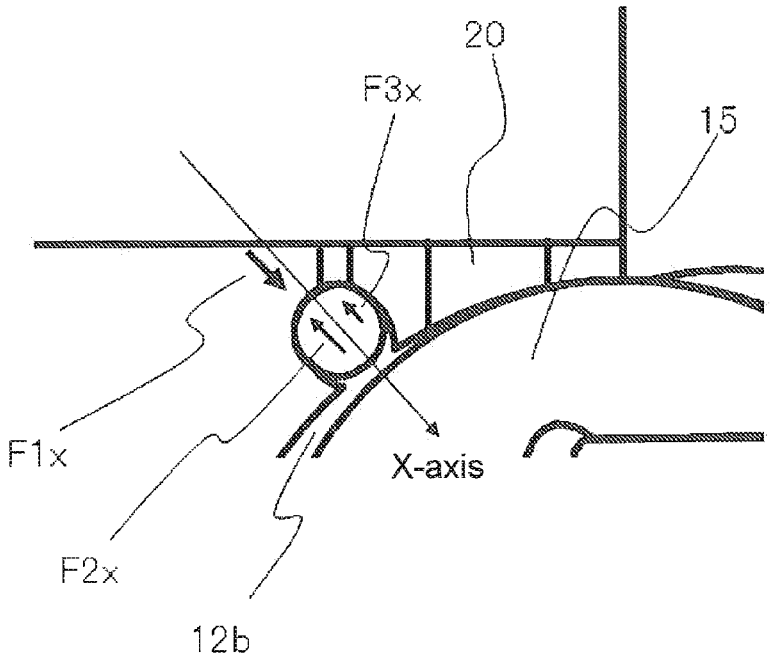
FIG. 8 is a second explanatory diagram of forces acting on the discharge valve of the vane rotary compressor according to the first embodiment of the present invention.

FIG. 7 shows a state in which the discharge valve 25 closes the discharge flow channel along which the refrigerant flows from the operating chamber 12*b* to the discharge hole 20 as in the state shown in FIG. 6A. FIG. 8 shows a state in which the discharge flow channel along which the refrigerant flows from the operating chamber 12*b* to the discharge hole 20 is open as in the states shown in FIGS. 6B and 6C.

External forces acting on the discharge valve 25 and opening/closing operation will be described with reference to FIGS. 7 and 8. First of all, the force pushing the discharge valve 25 from the discharge valve groove 21 side to the cylinder chamber 12 side due to the high-pressure refrigerant introduced from the discharge valve back pressure flow channel 22 acts on the discharge valve 25. It is assumed that the X-axis is the direction in which the discharge valve 25 reciprocally moves, i.e., the direction extending from the discharge valve groove 21 to the center (a) of the roller 15 (the center of the shaft 2), and F1*x* is the force acting on the discharge valve 25 from the discharge valve groove 21 side to the cylinder chamber 12 side. The force F1*x* is a force acting in the X-axis direction.

A force F2*z* acts from the cylinder chamber 12*b* side to push the discharge valve 25 owing to the refrigerant pressure inside the operating chamber 12*b*. It is assumed that F2*x* is a component force, of the force F2*z*, which acts in the X-axis direction to push the discharge valve 25 from the cylinder chamber 12 side to the discharge valve groove 21 side.

Likewise, a force F3*z* acts from the discharge hole 20 side to push the discharge valve 25 owing to the refrigerant pressure inside on the discharge hole 20 side. It its assumed that F3*x* is a component force, of the force F3*z*, which acts in the X-axis direction to push the discharge valve 25 from the cylinder chamber 12 side to the discharge valve groove 21 side.

Note that since the discharge valve 25 dote not move in any directions other than the direction along the discharge valve groove 21, external forces other than those in the X-axis direction are canceled or absorbed to vanish.

The resultant force of the force F1*x* pushing the discharge valve 25 in the X-axis direction and the forces F2*x* and F3*x* pushing the discharge valve 25 in the reverse direction determines the direction in which the discharge valve 25 moves inside the discharge valve groove 21.

If F1*x* is larger than the resultant force of F2*x* and F3*x*, i.e., F1*x*>(F2*x*+F3*x*), the discharge valve 25 is pushed to the discharge valve groove receiving portion 24 at the discharge valve groove opening portion 23, and partitions the operating chamber 12*b* and the discharge hole 20 with the roller outer circumferential surface 15*a* of the roller 15 and the outer circumferential surface of the discharge valve 25, thereby causing the discharge flow channel, along which the refrigerant flows from the operating chamber 12*b* to the discharge hole 20, to be closed.

When the roller 15 rotates and comes into the state shown in FIG. 8, the compression of the refrigerant in the operating chamber 12*b* progresses, and the refrigerant pressure rises. When the refrigerant pressure in the operating chamber 12*b* reaches a predetermined pressure and the resultant force of F2*x* and F3*x* becomes larger than F1*x*, i.e., F1*x*<(F2*x*+F3*x*), the discharge valve 25 is pushed back into the discharge valve groove 21 to form a flow channel between the discharge valve 25 and the roller outer circumferential surface 15*a*. As a consequence, the operating chamber 12*b* communicates with the discharge hole 20. When the operating chamber 12*b* communicates with the discharge hole 20, the high-pressure refrigerant compressed in the operating chamber 12*b* is discharged out of the cylinder 11 through the discharge hole 20.

When the roller 15 further rotates and the vane 16*b* passes through the position of the discharge valve 25 as shown in FIG. 6F, the operating chamber 12*b* disappears as the cylinder inner circumferential surface 11*a* comes close to the roller outer circumferential surface 15*a*. As a result, the process of discharging the refrigerant from the operating chamber 12*b* finishes. In addition, since the operating chamber 12*a* in a compression state comes into contact with the discharge valve 25 and the force Fx2 decreases, the discharge valve 25 is pushed out to the cylinder chamber 12 to close the discharge flow channel along which the refrigerant flows from the operating chamber to the discharge hole 20.

By means of the above process, the discharge valve 25 opens and closes the discharge flow channel along which the refrigerant flows from the operating chamber 12*b* to the discharge hole 20, thereby making the compression element 10 perform discharge operation. The compressor 100 then causes the compression element 10 to repeat the suction, compression, and discharge processes to circulate the refrigerant in the refrigerant circuit.

Assume that the discharge valve 25 is not provided on the discharge flow channel along which the refrigerant flows from the operating chamber 12*b* to the discharge hole 20, and a conventional discharge valve is provided at the opening portion of the discharge hole 20 which is located on the outer surface side of the cylinder 11. In this case, in a discharge operation process, the internal volume of the discharge hole 20 becomes a dead volume in which a high-pressure refrigerant which cannot be discharged into the high-pressure space stays. For example, the same discharge operation is performed until the vane 16*b* passes through the discharge hole 20 in FIG. 6F. When, however, the vane (corresponding to the vane 16*a* in FIG. 6A) passes through the discharge hole 20 as shown in FIG. 6A, the discharge valve on the outer surface of the cylinder 11 closes the discharge hole 20 on the outer surface side of the cylinder 11 due to the differential pressure between the outside of the cylinder 11 and the cylinder chamber 12 side (the operating chamber 12*b* in FIG. 6A). In this case, the high-pressure refrigerant stays in the discharge hole 20. When the discharge hole 20 in which this high-pressure refrigerant stays communicates with the operating chamber which performs the next discharge operation, since the pressure of the refrigerant in the operating chamber has not risen because the next operating chamber is at the compression stage, the high-pressure refrigerant staying in the discharge hole 20 flows back to the operating chamber 12*b*, and is re-expanded and re-compressed. That is, the high-pressure refrigerant staying in the dead volume causes a re-expansion loss, resulting in a deterioration in efficiency due to an increase in input.

In contrast to this, according to this embodiment, the discharge valve 25 is provided on the discharge flow channel along which the refrigerant flows from the operating chamber 12*b* to the discharge hole 20, but any discharge valve is not provided at the outer surface side opening portion of the cylinder 11. This makes it possible to prevent the discharge hole 20 from becoming a dead volume after discharge operation. That is, the discharge valve 25 disposed on the discharge flow channel along which the refrigerant flows from the operating chamber 12*b* to the discharge hole 20 can prevent the high-pressure refrigerant from flowing back from the discharge hole 20 to the operating chamber 12*b* by closing the flow channel between the discharge hole 20 and the operating chamber 12*b* which performs discharge operation next. It is possible to prevent a re-expansion loss caused when the high-pressure refrigerant flows back to the operating chamber 12*b* and to suppress a deterioration in efficiency due to an increase in input.

In addition, although the high-pressure refrigerant which cannot be discharged to the high-pressure space stays in the discharge hole 20, since the discharge hole 20 communicates with the high-pressure space, it is possible to prevent the discharge hole 20 and the discharge valve 25 from interfering with the discharge operation of the high-pressure refrigerant. This makes it possible to prevent the discharge hole 20 from becoming a dead volume after discharge operation.

Furthermore, the discharge valve 25 closes, by the outer circumferential surface of the discharge valve 25 and the roller outer circumferential surface 15*a*, the discharge flow channel along which the refrigerant flows from the operating chamber 12*b* to the discharge hole 20, meanwhile the discharge valve 25 is pushed back to the discharge valve groove 21 of the cylinder 11 to open the flow channel. When the discharge valve 25 opens the discharge flow channel, the discharge valve 25 does not interfere with the flow of the refrigerant on the discharge flow channel along which the refrigerant flows from the operating chamber 12*b* to the discharge hole 20 unlike the conventional countermeasure against a dead volume. It is therefore possible to prevent a pressure loss on the discharge flow channel at the time of discharge operation.

As described above, it is possible to obtain a compressor having a configuration in which a discharge valve is disposed on the discharge flow channel along which the refrigerant flows from the discharge hole upstream side in the vicinity of the discharge hole, i.e., from the operating chamber, to the discharge hole, the compressor suppressing a deterioration in the efficiency thereof due to an increase in compressor input, which occurs when opening/closing of the discharge flow channel makes the high-pressure refrigerant staying in the internal volume of the discharge hole flow back to the operating chamber and the flowback refrigerant is re-expanded and re-compressed, thereby causing a re-expansion loss.

It is also possible to prevent the high-pressure refrigerant which cannot be discharged to the high-pressure space from staying in the discharge hole after discharge operation and to prevent a deterioration in volume efficiency.

According to the conventional countermeasure against a dead volume, since the discharge valve is provided in the discharge hole, when the discharge valve opens, the discharge valve interferes with the refrigerant flowing along the flow channel, resulting in an increase in flow channel resistance. In contrast to this, according to this embodiment, since the discharge valve is pushed back to the discharge valve groove provided on the cylinder side and opens, the discharge valve does not interfere with the high-pressure refrigerant discharged from the operating chamber to the high-pressure space, thus preventing a large pressure loss at the time of discharge operation.

It is preferable to use a refrigerant with a low operating pressure, with which the force applied from the operating chamber to the vane is small. In addition, since the discharge valve groove receiving portion has a relatively thin shape, the force acting on the discharge valve groove receiving portion is preferably small. It is therefore preferable to use a refrigerant with a low operating pressure. For example, a refrigerant having a standard boiling point of not less than −45° C. is preferably used. More specifically, a refrigerant like R600a (isobutane), R600 (butane), R290 (propane), R134a, R152a, R161, R407C, R1234yf, or R1234ze can be used without raising any problems in terms of the strength of the vane and discharge valve groove receiving portion.

FIG. 2 shows the structure having the two vanes. However, the number of vanes to be used may be two or more. In this case, the operating chamber can be partitioned into a plurality of chambers in accordance with the number of vanes. In addition, even using one vane will form an operating chamber and hence can perform compressing operation. As described above, a vane rotary compressor can increase the number of operating chambers without increasing the size of the compression element portion by adding components such as a cylinder and a roller, and can increase the displacement while achieving space saving.

It is therefore possible to obtain a compressor which can increase the displacement while achieving space saving even by using a refrigerant having a low operating pressure.

Further, when the discharge valve is pushed to the cylinder chamber side, the outer circumferential surface of the discharge valve and the outer circumferential surface of the roller do not come into contact with each other and form a small gap therebetween. However, the outer circumferential surface of the discharge valve and the outer circumferential surface of the roller may come into contact with each other. Since the discharge valve can pivot, even if it comes into contact with the outer circumferential surface of the roller, the sliding loss is small, and it is possible to prevent the high-pressure refrigerant from flowing back from the discharge valve side to the operating chamber side. This can improve the abrasion resistance and prolong the service life of the compressor.

In addition, even if the vane comes into contact with the discharge valve, since the discharge valve can pivot, the sliding loss can be reduced, and a high-reliability compressor can be obtained.

According to the conventional countermeasures against a dead volume, since the range of movement of the discharge valve provided in the discharge valve is large, an operation delay occurs in the discharge valve, and some high-pressure refrigerant flows back from the high-pressure space to the operating chamber. However, since the range of movement of the discharge valve relative to the discharge valve groove is narrowed to improve the responsiveness of reciprocal movement inside the discharge valve groove, it is possible to close the flow channel without any operation delay after discharge operation. This makes it possible to inhibit the high-pressure refrigerant from flowing back from the high-pressure space to the operating chamber, which occurs due to an operation delay in the discharge valve.

Although another discharge valve is provided on the cylinder outer surface side of the discharge hole because of an operation delay in the discharge valve, there is no need to provide another discharge valve and locate discharge valves at two positions. This makes it possible to form a compressor including an inexpensive compression element portion while achieving space saving.

In addition, use of an almost cylindrical discharge valve having a hollow shape can achieve a reduction in sliding resistance. This valve can be moved with a small force and improve responsiveness. Furthermore, use of a lightweight metal material such as aluminum or titanium or an alloy material such as an aluminum base alloy or titanium base alloy for a discharge valve will achieve a further reduction in weight. This can further reduce the inertia force and improve the responsiveness of reciprocal movement of the discharge valve inside the discharge valve groove.

Furthermore, since the force with which the discharge valve is moved can be changed by changing the mass of the discharge valve other than the responsiveness, it is possible to regulate opening/closing conditions.

Moreover, since the discharge valve reciprocally moves inside the discharge valve groove, it is possible to reduce abrasion, make it difficult to produce abrasion powder, and prolong the service life of the compressor by forming an abrasion-resistant coating on the surface of at least one of the discharge valve and the discharge valve groove.

Although FIGS. 2 to 8 have exemplified the case in which the discharge valve is provided to make the direction of reciprocal movement of the discharge valve almost coincide with the normal direction of the almost cylindrical outer circumferential surface. However, the direction of reciprocal movement of the discharge valve need not always coincide with the normal direction of the roller outer circumferential surface. For example, the direction of reciprocal movement of the discharge valve may coincide with the normal direction of the almost cylindrical inner circumferential surface 11*a*, i.e., a direction to the center of the cylinder chamber 12. The component ratio of resultant force acting from the cylinder chamber to the discharge valve groove can be changed by changing the direction of reciprocal movement of the discharge valve. That is, it is possible to regulate the ratio between the force acting from the operating chamber side and the force acting from the discharge hole side and regulate opening/closing conditions for the discharge valve.

Second Embodiment

According to the first embodiment, the columnar discharge valve is used, and the high-pressure refrigerant in the high-pressure space is introduced from the outer surface of the cylinder into the discharge valve groove through the discharge valve back pressure flow channel. The discharge valve is then pushed out from the discharge valve groove to make the operating chamber communicate with the discharge hole and close the discharge flow channel along which the refrigerant flows from the operating chamber to the discharge hole. However, the force with which the discharge valve is pushed out from the discharge valve groove to the cylinder chamber depends on the refrigerant pressure in the high-pressure space which is introduced from the discharge valve back pressure flow channel. If the refrigerant pressure in the high-pressure space is not sufficiently high, the force with which the discharge valve is pushed out from the discharge valve groove to the cylinder chamber may not be sufficient. The second embodiment will therefore exemplify a case in which a spring as biasing means is disposed in the discharge valve groove to compensate for the force with which the discharge valve is pushed out of the discharge valve groove.

Figure 9:
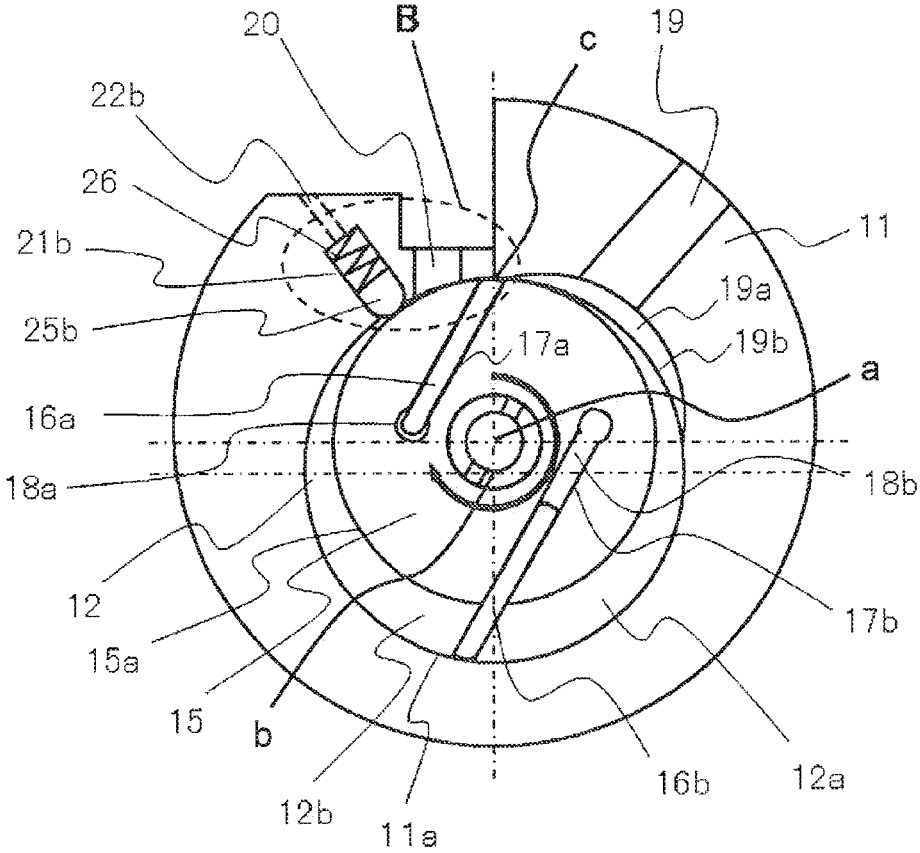
FIG. 9 is a cross-sectional view of the compression element portion of a vane rotary compressor according to a second embodiment of the present invention.
Figure 10:
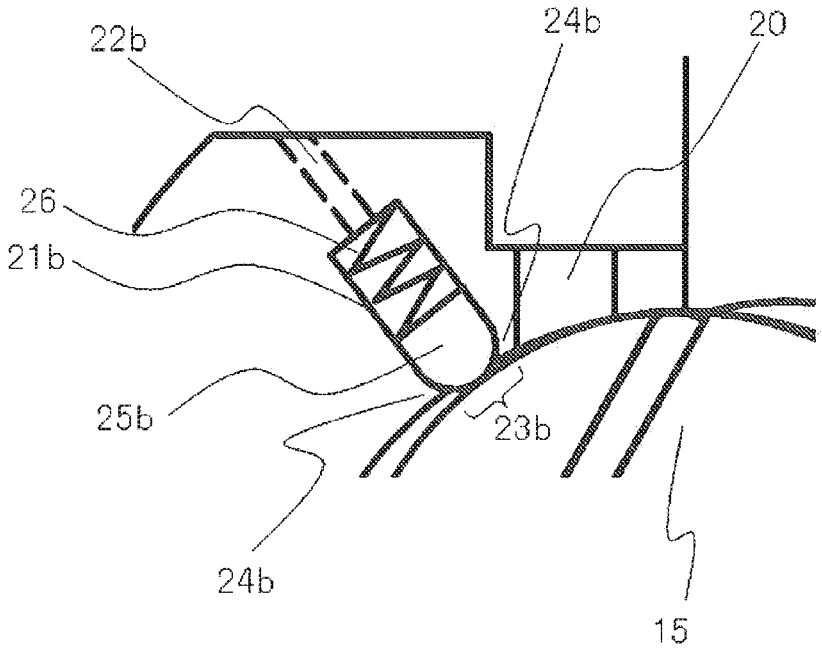
FIG. 10 is a partial enlarged view of a portion around the discharge valve of the vane rotary compressor according to the second embodiment of the present invention.

Like FIG. 2, FIG. 9 is a cross-sectional view of the compression element portion taken along the line D-D of the vane rotary compressor 100 shown in FIG. 1. The same reference numerals as in FIG. 2 denote the same or like components in FIG. 9. FIG. 10 is an enlarged view of a portion around a discharge valve 25*b* and a discharge hole 20 in FIG. 9, i.e., a portion around a portion B. This portion will be described in detail with reference to FIG. 10.

Figure 11:
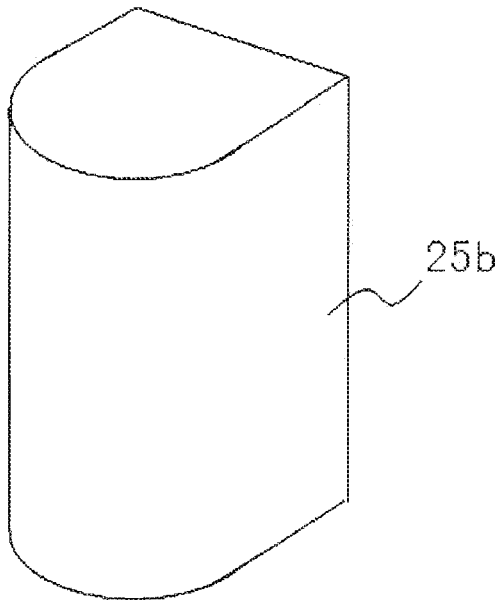
FIG. 11 is a perspective view of the discharge valve of the vane rotary compressor according to the second embodiment of the present invention.

Referring to FIG. 10, like FIGS. 2 and 3, a discharge valve groove 21*b* is a groove extending through a cylinder chamber 12 provided in a cylinder 11 in the axial direction, and has a discharge valve groove opening portion 23*b* open to the cylinder chamber 12. The discharge valve groove opening portion 23*b* is also formed throughout the total length of a cylinder inner circumferential surface 11*a* in the axial direction. The discharge valve groove opening portion 23*b* is provided with a discharge valve groove receiving portion 24*b*. The discharge valve 25*b* is reciprocally movably inserted in the discharge valve groove 21*b*. As shown in FIG. 11, the discharge valve 25*b* has an almost rectangular parallelepiped shape as a whole, whose length in the axial direction is almost equal to that of a discharge valve groove 21. When being pushed out to the discharge valve groove opening portion 23*b* side, the discharge valve 25*b* is locked to the discharge valve groove receiving portion 24*b* with a portion of the discharge valve 25*b* protruding to the cylinder chamber 12.

The discharge valve 25*b* and the discharge valve groove 21*b* are provided such that the reciprocal movement of the discharge valve 25*b* is directed to the normal direction of an almost cylindrical roller outer circumferential surface 15*a*, i.e., a shaft 2 in the center of a roller 15. Note that the discharge valve 25*b* and the discharge valve groove 21*b* may be provided such that the reciprocal movement of the discharge valve 25*b* is directed to the normal direction of the almost cylindrical cylinder inner circumferential surface 11*a*, i.e., the center of the cylinder 11.

In addition, the position of the discharge valve groove 21*b* is the same as that in FIGS. 2 and 3. That is, the discharge valve groove 21*b* is disposed, in the vicinity of the discharge hole 20, in the cylinder 11 at the discharge flow channel which makes an operating chamber 12*b* communicate with the discharge hole 20 and along which a refrigerant flows from the operating chamber 12*b* to the discharge hole 20. That is, the discharge valve groove 21*b* is disposed on the opposite side of the discharge hole 20 to the side where a nearest neighbor point (c) is disposed.

The discharge valve 25*b* pushed to the cylinder chamber 12 partitions the cylinder chamber 12 with the outer circumferential surface of the discharge valve 25*b* and the almost cylindrical roller outer circumferential surface 15*a*. Note however that the outer circumferential surface of the discharge valve 25*b* and the roller outer circumferential surface 15*a* do not come into contact with each other and form a small gap, which is sealed and closed with a refrigerating machine oil 3 supplied to a compression element 10. This makes it possible to partition the cylinder chamber 12 with the outer circumferential surface of the discharge valve 25*b* and the roller outer circumferential surface 15*a*. Note that the length of the discharge valve 25*b* in the axial direction is almost equal to that of the cylinder 11 or roller 15, and the discharge valve groove 21*b* and the discharge valve groove opening portion 23*b* are also formed throughout the total length of the cylinder 11 in the axial direction.

The discharge valve groove 21*b* is provided with a discharge valve back pressure flow channel 22*b*, and makes the discharge valve groove 21*b* communicate with a high-pressure space in the closed vessel 1 outside the cylinder 11. The discharge valve back pressure flow channel 22*b* introduces a high-pressure refrigerant to the high-pressure space in the discharge valve groove 21*b*. The introduced high-pressure refrigerant acts to push out the discharge valve 25*b* into the cylinder chamber 12. The pushed discharge valve 25*b* closes the discharge flow channel along which the refrigerant flows from the operating chamber 12*b* in the cylinder chamber 12 to the discharge hole 20.

Note that when the refrigerant pressure in the operating chamber 12*b* becomes a predetermined pressure, the discharge valve 25*b* is pushed back to the discharge valve groove 21*b* to open the discharge flow channel along which the refrigerant flows from the operating chamber 12*b* to the discharge hole 20.

As shown in FIG. 11, the discharge valve 25*b* has an almost rectangular parallelepiped shape as a whole, and the surface of the discharge valve 25*b* which is pushed out from the discharge valve groove opening portion 23*b* and faces the roller outer circumferential surface 15*a*, i.e., the distal end of the discharge valve 25*b*, has a semicircular columnar shape.

Note that the distal end may not have a semicircular columnar shape but may be shaped such that the corner portions of the rectangular parallelepiped, i.e., the connecting portion between the surfaces, are rounded. If the distal end has a semicircular columnar shape, the semicircular columnar outer circumferential surface of the discharge valve 25*b* and the almost cylindrical roller outer circumferential surface 15*a* close the flow channel at one point in the radial direction and at a nearest neighbor point on a line in the axial direction. If the distal end has a rectangular parallelepiped shape, a nearest neighbor point is formed by a surface, which can close the flow channel thoroughly in a wider range.

A spring 26 as biasing means is provided between the discharge valve groove 21*b* and the opposite side of the discharge valve 25*b* to the distal end portion which is pushed out. One end face of the spring 26 is in contact with the opposite surface of the discharge valve groove 21*b* to the discharge valve groove opening portion 23*b*, and the other end face is in contact with the opposite surface of the discharge valve 25*b* to the side where the discharge valve 25*b* is pushed out from the discharge valve groove opening portion 23*b*. The end faces of the spring 26 need not be respectively fixed to the discharge valve groove 21*b* and the discharge valve 25*b*. In order to sufficiently transfer the force of the spring 26, the portions of the discharge valve groove 21*b* and discharge valve 25*b* which are in contact with the spring 26 are preferably flat. In addition, a plurality of springs 26 may be provided to push the almost rectangular parallelepiped discharge valve 25*b*. Providing a plurality of springs 26 makes it possible to translate the discharge valve groove 21*b* by pushing the two end sides of the discharge valve 25*b*.

Due to this arrangement, the spring 26 compensates for the action of pushing out the discharge valve 25*b* from the discharge valve groove opening portion 23*b* to the cylinder chamber 12.

The operation of this arrangement will be described next. The process operations including the operation of the overall compressor and the suction to the discharge of the compressor are almost the same as those described above. The state of the operating chamber 12*b* in FIG. 6A in the process of compressing the refrigerant in the operating chamber after the refrigerant is sucked into the operating chamber will be described first. In the same manner as in the first embodiment, in this process, the refrigerant pressure reaches a predetermined pressure, i.e., the discharge pressure, and the discharge valve 25*b* operates. This process will be described with reference to FIGS. 12 and 13 in the same manner as described above.

Figure 12:
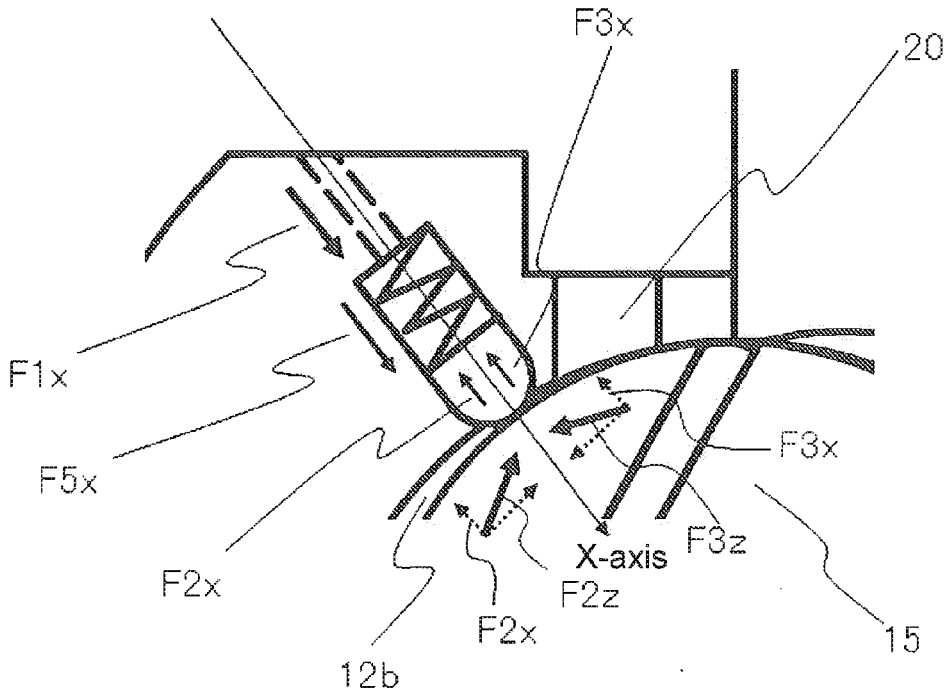
FIG. 12 is a first explanatory diagram of forces acting on the discharge valve of the vane rotary compressor according to the second embodiment of the present invention.

Like FIG. 7, FIG. 12 shows a state in which the discharge valve 25*b* partitions the operating chamber 12*b* from the discharge hole 20 and closes the discharge flow channel along which the refrigerant flows from the operating chamber 12*b* to the discharge hole 20. Like FIG. 8, FIG. 12 shows a state in which the operating chamber 12*b* communicates with the discharge hole 20 to open the discharge flow channel along which the refrigerant flows from the operating chamber 12*b* to the discharge hole 20.

Figure 13:
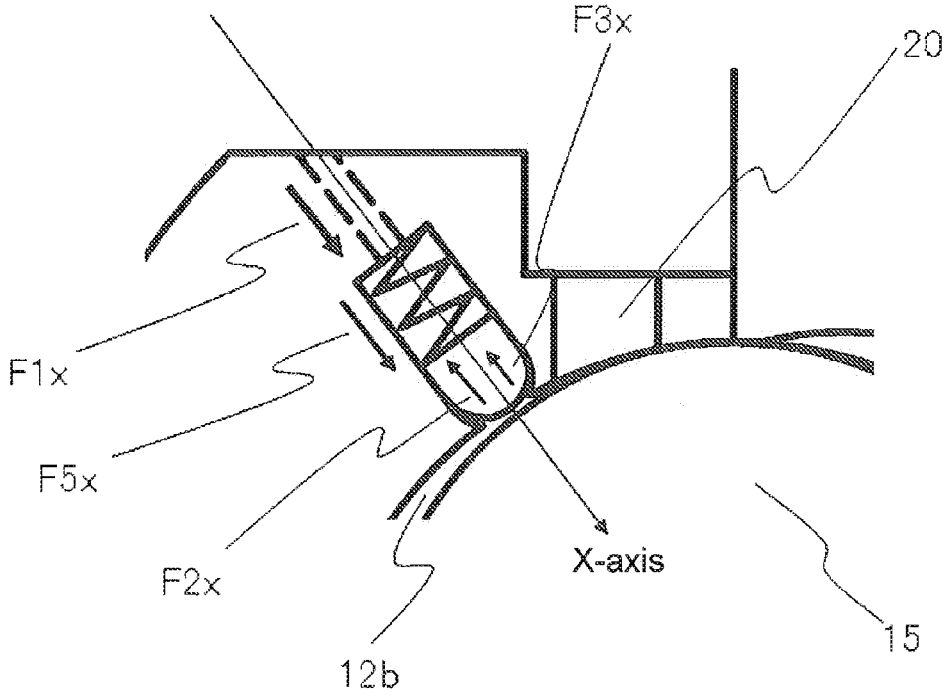
FIG. 13 is a second explanatory diagram of forces acting on the discharge valve of the vane rotary compressor according to the second embodiment of the present invention.

The external forces acting on the discharge valve 25*b* and its opening/closing operation will be described with reference to FIGS. 12 and 13. Referring to FIGS. 12 and 13, the X-axis coincides with the direction in which the discharge valve 25*b* reciprocally moves, i.e., the direction extending from the discharge valve groove 21*b* to the center (a) of the roller 15 (the center of the shaft 2). Forces F1*x*, F2*x*, and F3*x* acting on the discharge valve 25*b* are the same as those in FIGS. 7 and 8. In addition to them, a force F5*x* acts on the discharge valve 25*b* in the X-axis direction in which the spring 26 pushes the discharge valve 25*b* from the discharge valve groove 21*b* side to the cylinder chamber 12 side.

As in the case shown in FIGS. 7 and 8, the resultant force of the forces F1*x* and F5*x* pushing the discharge valve 25*b* in the X-axis direction and the resultant force of the forces F2*x* and F3*x* pushing the discharge valve 25*b* in the reverse direction determine the direction in which the discharge valve 25*b* moves inside the discharge valve groove 21*b*.

If the resultant force of the forces F1*x* and F5*x* pushing the discharge valve 25*b* in the X-axis direction is larger than the resultant force of F2*x* and F3*x* pushing the discharge valve 25*b* in the reverse direction, i.e., (F1*x*+F5*x*)>(F2*x*+F3*x*), the discharge valve 25*b* is pushed to the discharge valve groove receiving portion 24*b* at the discharge valve groove opening portion 23*b*, and partitions the operating chamber 12*b* from the discharge hole 20 with the outer circumferential surface of the roller 15 and the outer circumferential surface of the discharge valve 25*b*, thereby closing the discharge flow channel along which the refrigerant flows from the operating chamber 12*b* to the discharge hole 20.

When the roller 15 rotates and comes into the state shown in FIG. 13, the compression of the refrigerant in the operating chamber 12*b* progresses, and the refrigerant pressure rises. When the refrigerant pressure in the operating chamber 12*b* reaches a predetermined pressure and the resultant force of F2*x* and F3*x* becomes larger than the resultant force of F1*x* and F5*x*, i.e., (F1*x*+F5*x*)<(F2*x*+F3*x*), the discharge valve 25*b* is pushed back into the discharge valve groove 21*b* to form a flow channel between the discharge valve 25*b* and the roller outer circumferential surface 15*a*. As a consequence, the operating chamber 12*b* communicates with the discharge hole 20. When the operating chamber 12*b* communicates with the discharge hole 20, the high-pressure refrigerant compressed in the operating chamber 12*b* is discharged out through the discharge hole 20.

When the roller 15 further rotates and the vane 16*b* passes through the position of the discharge valve 25*b* as shown in FIG. 6F, the operating chamber 12*b* disappears. As a result, the process of discharging the refrigerant from the operating chamber 12*b* finishes. In addition, since the operating chamber 12*a* in a compression state comes into contact with the discharge valve 25*b* and the force Fx2 decreases, the discharge valve 25*b* is pushed out to the cylinder chamber 12 to close again the discharge flow channel along which the refrigerant flows from the operating chamber to the discharge hole 20.

Due to the above process, the discharge valve 25*b* opens and closes the discharge flow channel along which the refrigerant flows from the operating chamber 12*b* to the discharge hole 20, whereby the compression element 10 performs discharge operation. A compressor 100 then causes the compression element 10 to repeat the suction, compression, and discharge processes to circulate the refrigerant in the refrigerant circuit.

In this embodiment, as in the first embodiment, by providing the discharge valve 25*b* on the discharge flow channel along which the refrigerant flows from the operating chamber 12*b* to the discharge hole 20, it is possible to prevent the discharge hole 20 from becoming a dead volume after discharge operation. This makes it possible to prevent the high-pressure refrigerant from flowing back from the discharge hole 20 to the operating chamber 12*b* by closing the flow channel between the discharge hole 25 and the operating chamber 12*b* which performs discharge operation next. This can prevent re-expansion loss caused at this time and suppress a deterioration in efficiency due to an increase in input.

In addition, the discharge hole 20 always communicates with the high-pressure space. This can prevent the high-pressure refrigerant which cannot be discharged to the high-pressure space from staying in the discharge hole.

In the arrangement like that in the first embodiment, the force with which the discharge valve is pushed out from the discharge valve groove to the cylinder chamber depends on the refrigerant pressure in the high-pressure space which is introduced from the discharge valve back pressure flow channel. If the refrigerant pressure in the high-pressure space is not sufficiently high, the force with which the discharge valve is pushed out from the discharge valve groove to the cylinder chamber may not be sufficient. If the pushing force is not sufficient, it is not possible to sufficiently close the discharge flow channel along which the refrigerant flows from the operating chamber to the discharge hole. As a consequence, the refrigerant flows from the high-pressure space to the operating chamber through the discharge hole, resulting in generation of a re-expansion loss.

In contrast to this, the second embodiment provides the spring 26 as biasing means in the discharge valve groove 21*b*. This makes it possible to push out the discharge valve 25*b* to the cylinder chamber 12 with the force of the spring 26 even if the refrigerant pressure in the high-pressure space is not sufficiently high. This can reliably close the discharge flow channel along which the refrigerant flows from the operating chamber 12*b* to the discharge hole 20, even if the refrigerant pressure in the high-pressure space is not sufficiently high, thereby making it possible to prevent a deterioration in efficiency due to a re-expansion loss.

Note that such insufficiency of the refrigerant pressure in the high-pressure space occurs not only when the compressor starts but also when a motor element 40 of the compressor is controlled at variable speeds by using a frequency converter for an external power supply. The frequency converter variably changes the frequency and voltage value of a voltage to be applied, and can variably change the rotation speed of the motor element 40 of the compressor from, for example, 0 rps to about 200 rps. Rotating the compressor at a low speed will suppress the refrigeration capacity by decreasing the amount of refrigerant circulating in the refrigerant circuit. Rotating the compressor at a high speed will increase the refrigeration capacity by increasing the amount of refrigerant circulating in the refrigerant circuit. Many of household appliances, which have been oriented to energy saving, in particular, use brushless DC motors. A brushless DC motor, which cannot be driven by a commercial power supply, needs a frequency converter, i.e., an inverter. Such control on the amount of refrigerant circulated is done as a matter of course. In contrast to this, when the motor element 40 of the compressor is driven at a low speed of about 20 rps or less, since the speed of feeding the high-pressure refrigerant to the high-pressure space is low, the refrigerant pressure in the high-pressure space does not become sufficiently high. In such a case as well, it is possible to reliably close, by means of the auxiliary force of the spring 26, the discharge flow channel along which the refrigerant flows from the operating chamber 12*b* to the discharge hole 20.

As described above, it is possible to obtain a compressor having a configuration in which a discharge valve is disposed on the discharge flow channel along which the refrigerant flows from the discharge hole upstream side in the vicinity of the discharge hole, i.e., from the operating chamber, to the discharge hole, the compressor suppressing a deterioration in the efficiency thereof due to an increase in compressor input, which occurs when opening/closing of the discharge flow channel makes the high-pressure refrigerant staying in the internal volume of the discharge hole flow back to the operating chamber and the flowback refrigerant is re-expanded and re-compressed, thereby causing a re-expansion loss.

It is also possible to prevent the high-pressure refrigerant which cannot be discharged to the high-pressure space from staying in the discharge hole after discharge operation and to prevent a deterioration in volume efficiency.

Even if the refrigerant pressure in the high-pressure space is not sufficiently high, the biasing means provided for the discharge valve allows to reliably close the discharge flow channel along which the refrigerant flows from the operating chamber to the discharge hole. This can prevent a deterioration in efficiency due to a re-expansion loss.

According to the conventional countermeasure against a dead volume, since the discharge valve is provided in the discharge hole, when the discharge valve opens, the discharge valve interferes with the refrigerant flowing along the flow channel, resulting in an increase in flow channel resistance. In contrast to this, according to this embodiment, since the discharge valve is pushed back to the discharge valve groove provided on the cylinder side and opens, the discharge valve does not interfere with the high-pressure refrigerant discharged from the operating chamber to the high-pressure space even if the biasing means is provided, thus making it possible to prevent a large pressure loss at the time of discharge operation.

It is preferable to use a refrigerant with a low operating pressure, with which the force applied from the operating chamber to the vane is small. In addition, since the discharge valve groove receiving portion has a relatively thin shape, the force acting on the discharge valve groove receiving portion is preferably small. It is therefore preferable to use a refrigerant having a low operating pressure. For example, a refrigerant having a standard boiling point of not less than −45° C. is preferably used. More specifically, a refrigerant like R600a (isobutane), R600 (butane), R290 (propane), R134a, R152a, R161, R407C, R1234yf, or R1234ze can be used without raising any problems in terms of the strength of the vane and discharge valve groove receiving portion, even if the biasing means is provided in the discharge valve.

In addition, using one or more vanes can form an operating chamber, and using a plurality of vanes can partition the operating chamber into a plurality of operating chambers. It is therefore possible to increase the number of operating chambers without increasing the size of the compression element portion and to increase the displacement while achieving space saving.

It is therefore possible to obtain a compressor which can increase the displacement while achieving space saving even if a refrigerant having a low operating pressure is used.

In addition, providing the biasing means will further improve the responsiveness of reciprocal movement of the discharge valve inside the discharge valve groove and can close the flow channel without any operation delay upon completion of discharge operation. This can inhibit the high-pressure refrigerant from flowing back from the high-pressure space to the operating chamber, which occurs due to an operation delay in the discharge valve. There is no need to provide another discharge valve on the cylinder outer surface side of the discharge hole, which has been required for the conventional countermeasure against a dead volume. It is therefore unnecessary to locate discharge valves at two positions. This makes it possible to form a compressor including an inexpensive compression element portion while achieving space saving.

In addition, use of a lightweight metal material such as aluminum or titanium or an alloy material such as an aluminum base alloy or titanium base alloy for a discharge valve will achieve a further reduction in weight. This can further reduce the inertia force and improve the responsiveness of reciprocal movement of the discharge valve inside the discharge valve groove.

Furthermore, it is possible to regulate opening/closing conditions by changing the mass of the discharge valve other than the responsiveness.

Moreover, since the discharge valve reciprocally moves inside the discharge valve groove, it is possible to reduce abrasion, make it difficult to produce abrasion powder, and prolong the service life of the compressor by forming an abrasion-resistant coating on the surface of at least one of the discharge valve and the discharge valve groove.

It is also possible to regulate opening/closing conditions for the discharge valve by changing the direction of reciprocal movement of the discharge valve. Referring to FIGS. 9 to 13, the direction of the reciprocal movement of the discharge valve 25*b* coincides with the normal direction of the almost cylindrical roller outer circumferential surface 15*a* or the normal direction of the almost cylindrical cylinder inner circumferential surface 11*a*. In contrast, referring to FIG. 14, the reciprocal movement of the discharge valve 25*b* is directed to a direction other than the normal direction of the roller outer circumferential surface 15*a* or cylinder inner circumferential surface 11*a*. That is, the direction of the reciprocal movement has a predetermined inclination in the circumferential direction relative to the normal direction of the roller outer circumferential surface 15*a* or cylinder inner circumferential surface 11*a*. FIG. 15 is an enlarged view of a portion around a portion C in FIG. 14.

Referring to FIG. 15, it is assumed that the Y-axis is the direction in which the discharge valve 25*b* reciprocally moves. It is assumed that F1*x* is the force acing in the Y-axis direction to make the high-pressure refrigerant introduced from the discharge valve back pressure flow channel 22*b* push the discharge valve 25*b* from the discharge valve groove 21*b* side to the cylinder chamber 12 side.

It is assumed that F5*y* is the force acting in the Y-axis direction to make the spring 26 push the discharge valve 25*b* from the discharge valve groove 21*b* side to the cylinder chamber 12 side.

It is assumed that F2*y* is the force, of a force F2*z* acting from the operating chamber 12*b* side to the discharge valve 25*b*, which acts in the Y-axis direction to push the discharge valve 25*b* from the cylinder chamber 12 side to the discharge valve groove 21*b* side.

Likewise, it is assumed that F3*y* is the force, of a force F3*z* acting from the discharge hole 20 side to the discharge valve 25*b*, which acts in the Y-axis direction to push the discharge valve 25*b* from the cylinder chamber 12 side to the discharge valve groove 21 side.

Like FIGS. 12 and 13, referring to FIG. 15, the resultant force of the forces F1*y* and F5*y* pushing the discharge valve 25*b* in the Y-axis direction and the resultant force of the forces F2*y* and F3*y* pushing the discharge valve 25*b* in the reverse direction determine the direction in which the discharge valve 25*b* moves inside the discharge valve groove 21*b*. If (F1*y*+F5*y*)>(F2*y*+F3*y*), the discharge valve 25*b* closes the discharge flow channel. If (F1*y*+F5*y*)<(F2*y*+F3*y*), the discharge valve 25*b* opens the discharge flow channel.

If, however, the direction of the reciprocal movement of the discharge valve 25*b* is inclined to the discharge hole 20 side relative to the normal direction of the almost cylindrical roller outer circumferential surface 15*a*, as shown in FIG. 15, the component F2*y* of the resultant force pushing the discharge valve 25*b* from the cylinder chamber 12 side to the discharge valve groove 21*b* side increases. As a consequence, the force acting from the operating chamber 12*b* side, i.e., the refrigerant pressure in the operating chamber 12*b*, mainly opens and closes the discharge valve.

It is possible to flexibly regulate pressure conditions for the refrigerant in the high-pressure space, which opens and closes the discharge valve, and the operating chamber by regulating the direction of the reciprocal movement of the discharge valve 25*b* so as to have a predetermined inclination in the circumferential direction relative to the normal direction of the roller outer circumferential surface 15*a* or cylinder inner circumferential surface 11*a* in this manner.

In addition, the spring 26 comes into contact with the opposite surface of the discharge valve 25*b* to the distal end. Since the abutment surface of the spring 26 is flat, making the discharge valve 25*b* have a flat surface with which the spring 26 comes into contact makes it easy to transfer stress to the discharge valve 25*b*. Therefore, the discharge valve 25*b* is made to have a rectangular parallelepiped shape. However, the discharge valve 25*b* is moved by the high-pressure refrigerant from the discharge valve back pressure flow channel 22*b*, and the spring 26 assists the movement of the discharge valve 25*b*. For this reason, since the spring 26 need not apply a large force to the discharge valve 25*b*, the discharge valve may have a columnar shape or cylindrical shape as in the first embodiment. That is, the abutment surfaces of the spring 26 and discharge valve may not be flat surfaces.

Figure 16:
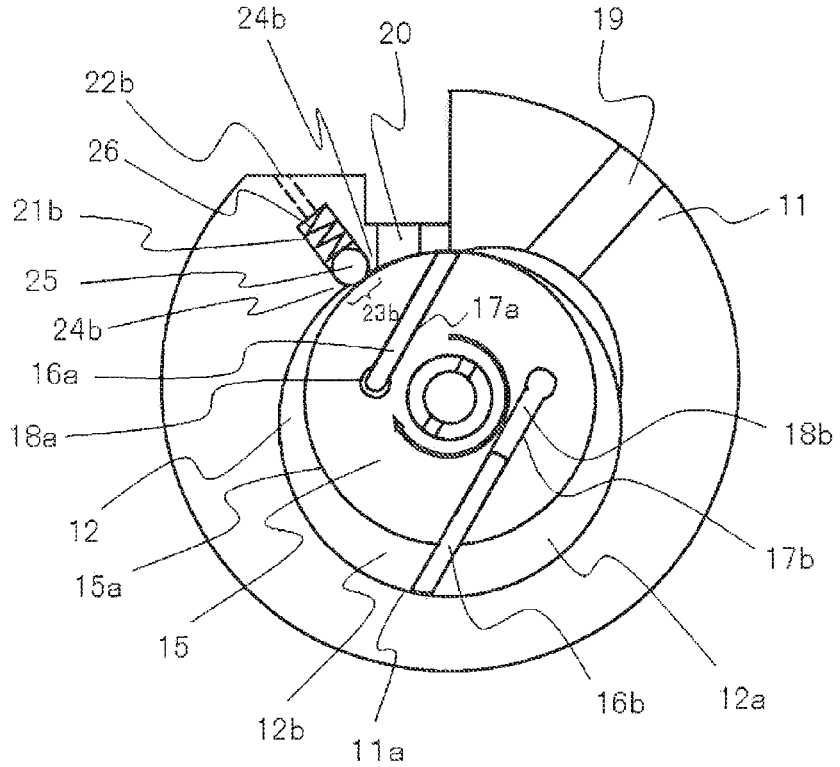
FIG. 16 is an explanatory diagram of a form in which the discharge valve of the vane rotary compressor according to the second embodiment of the present invention is changed.

FIG. 16 shows a case in which a columnar discharge valve 25 or a cylindrical discharge valve 25*a* is used, and the spring 26 assists a pushing force. The same reference numerals as in FIGS. 2 and 9 denote the same parts. The columnar discharge valve 25 or the cylindrical discharge valve 25*a* is accommodated in the discharge valve groove 21*b*. The spring 26 is accommodated on the opposite side of the discharge valve groove 21*b* to the discharge valve groove opening portion 23*b*. In this arrangement, the spring 26 pushes the discharge valve 25 or 25*a* to the discharge valve groove opening portion 23*b*. A discharge valve back pressure flow channel 22*b* communicates with the discharge valve groove 21*b*. The high-pressure refrigerant in the high-pressure space pushes the discharge valve 25 or 25*a* to the discharge valve groove opening portion 23*b* through the discharge valve back pressure flow channel 22*b*. Due to this operation, a portion of the discharge valve 25 is pushed from the discharge valve groove opening portion 23*b* to the cylinder chamber 12. If the pressure of the high-pressure refrigerant flowing into the discharge valve groove is not sufficient, the spring 26 assists the force pushing the discharge valve 25 or 25*a*.

Due to this operation, even if the refrigerant pressure in the high-pressure space is not sufficiently high as in FIG. 9, it is possible to reliably close the discharge flow channel along which the refrigerant flows from the operating chamber to the discharge hole. At the same time, the spring 26 comes into contact with the discharge valve 25 or 25*a* with a small contact area, resulting in a state in which the discharge valve 25 or 25*a* is pivotally provided, as in the case shown in FIG. 2. Even if, therefore, the discharge valve 25 or 25*a* comes into contact with vanes 16*a* and 16*b*, the valve pivots to reduce friction, thus obtaining a compressor having a small sliding loss.

Figure 14:
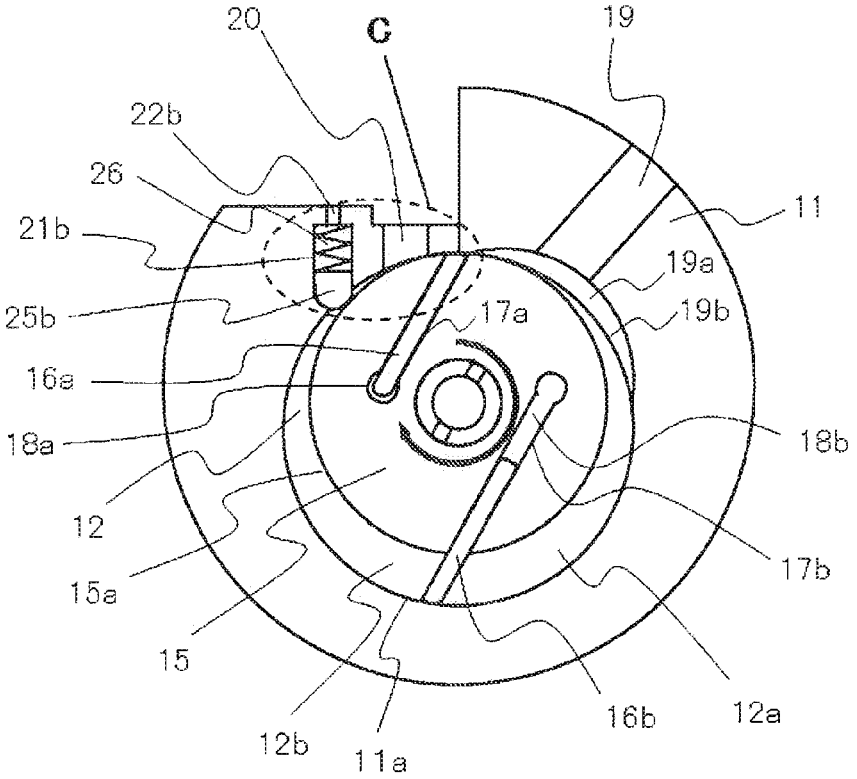
FIG. 14 is a transverse sectional view of a compression element portion in a form in which the angle of a discharge valve groove of the vane rotary compressor according to the second embodiment of the present invention is changed.
Figure 15:
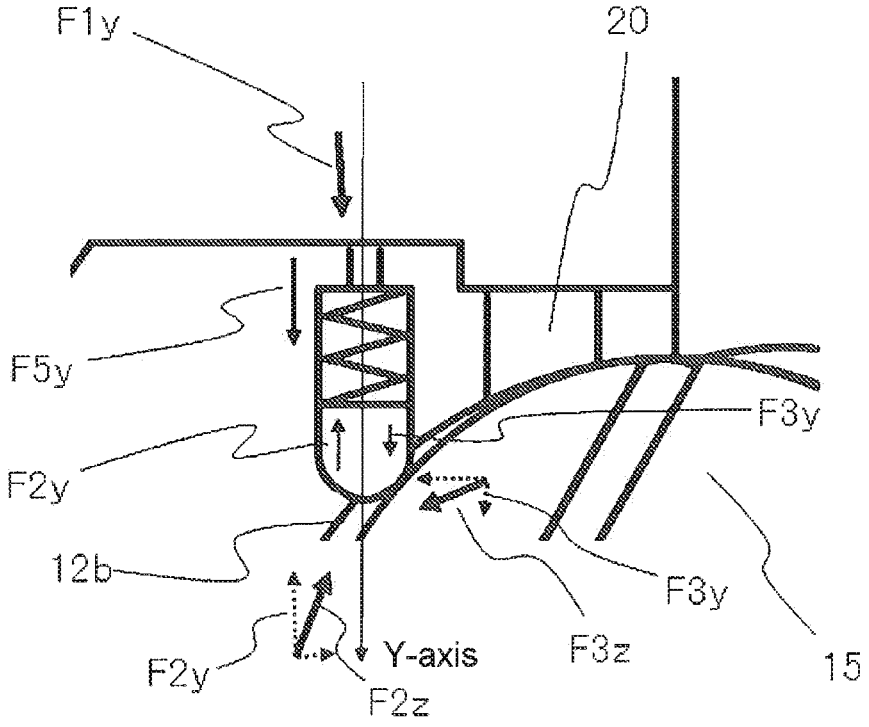
FIG. 15 is a partial enlarged view of a portion around the discharge valve in a form in which the discharge valve groove of the vane rotary compressor according to the second embodiment of the present invention is changed.
Figure 17:
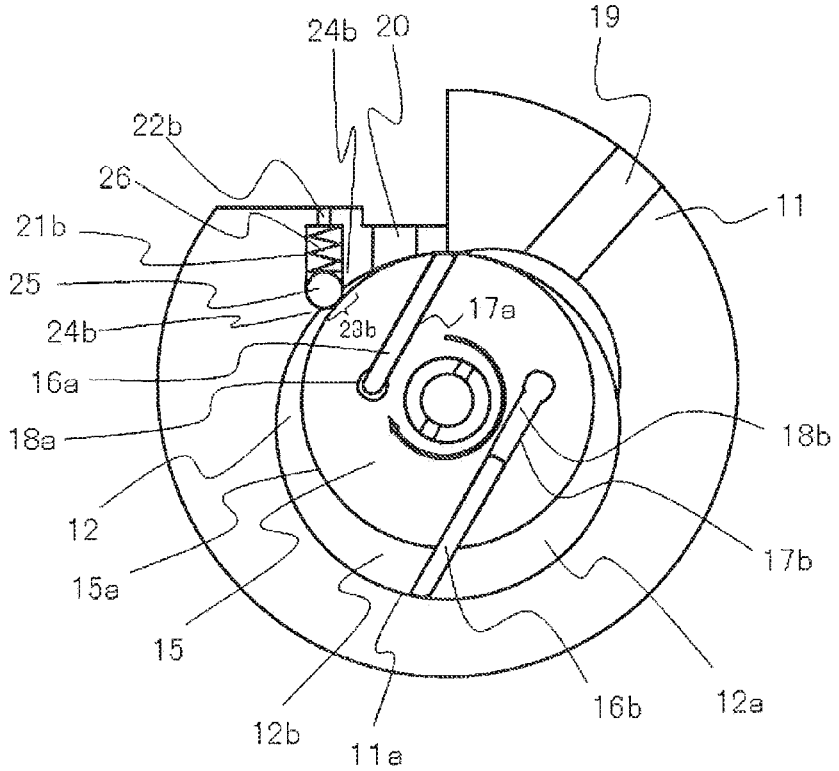
FIG. 17 is an explanatory diagram of a form in which the discharge valve groove of the vane rotary compressor according to the second embodiment of the present invention is changed.

In the case shown in FIG. 16, as in FIGS. 14 and 17, the direction in which the discharge valve 25 or 25*a* and the discharge valve groove 21*b* are provided, i.e., the direction of the reciprocal movement of the discharge valve 25 or 25*a*, can be made to have a predetermined inclination in the circumferential direction relative to the normal direction of the almost cylindrical roller outer circumferential surface 15*a*. This makes it possible to flexibly regulate pressure conditions for the refrigerant in the high-pressure space, which opens and closes the discharge valve, and the operating chamber.

In addition, when the discharge valve 25 or 25*b* is pushed from the discharge valve groove opening portion 23*b* to the cylinder chamber 12, the discharge valve is also pushed out by the pressure of the high-pressure refrigerant from the discharge valve back pressure flow channel 22*b*. For this reason, the spring 26 need not always be in contact with the discharge valve 25 or 25*b*.

For example, one end face of the spring 26 is fixed to the opposite surface of the discharge valve groove 21*b* to the discharge valve groove opening portion 23*b*, and the other end face comes into contact with the discharge valve 25 or 25*b* when the discharge valve 25 or 25*b* is pushed back into the discharge valve groove 21*b*. When a portion of the discharge valve 25 or 25*b* is pushed out to the cylinder chamber 12 by a predetermined amount or more, the spring 26 separates from the discharge valve 25 or 25*b* to make the biasing force zero. That is, the discharge valve 25 or 25*b* can close the discharge flow channel even with the above arrangement in which when a portion of the discharge valve 25 or 25*b* is pushed out to the cylinder chamber 12 and close half or more of the flow channel sectional area in the vicinity of the discharge valve groove opening portion 23*b* of the discharge flow channel along which the refrigerant flows from the operating chamber 12*b* to the discharge hole 20, the spring 26 separates from the discharge valve 25 or 25*b* to make the biasing force of the spring 26 zero. This is because, if the spring 26 assists to push the discharge valve 25 or 25*b* by a predetermined amount or more, it is possible to push the discharge valve 25 or 25*b* with the pressure of the high-pressure refrigerant from the discharge valve back pressure flow channel 22*b*. Note that the flow channel sectional area of the discharge flow channel is the area of a cross section obtained by cutting the space between the cylinder inner circumferential surface 11*a* and the roller outer circumferential surface 15*a* along a plane passing through the center of the shaft 2 or the center of the cylinder 11.

Due to this arrangement, even if the refrigerant pressure in the high-pressure space is not sufficiently high, it is possible to close the discharge flow channel along which the refrigerant flows from the operating chamber to the discharge hole. In addition, since the force of the spring 26 is not applied when the discharge valve 25 or 25*b* is pushed out to the discharge valve groove receiving portion 24*b*, there is no need to make the discharge valve groove receiving portion 24*b* have an extra strength, and a compressor having higher reliability can be obtained.

In addition, if the discharge valve has a columnar shape or cylindrical shape, the end face of the spring 26 does not come into contact with the discharge valve 25 to allow the discharge valve 25 to pivot more freely, and therefore, a high-efficiency compressor having with small friction and sliding losses can be obtained.

Third Embodiment

The first and second embodiments have exemplified the contact typevane rotary compressor in which the vanes move in contact with the inner circumferential surface of the cylinder, in which the discharge valve is provided on the discharge flow channel which makes the operating chamber communicate with the discharge hole and along which the refrigerant flows from the operating chamber to the discharge hole. In contrast to this, there is available a noncontact type vane rotary compressor of a noncontact system in which the vanes move without contact with the inner circumferential surface of the cylinder while keeping a predetermined distance. Even in such a vane rotary compressor, it is possible to prevent the internal volume of the discharge hole from becoming a dead volume by providing a discharge valve on the discharge flow channel along which the refrigerant flows from the operating chamber to the discharge hole, as in the first and second embodiments.

A vane rotary compressor in which the vanes do not come into contact with the inner circumferential surface of the cylinder will be described with reference to FIGS. 18 and 19.

Figure 18:
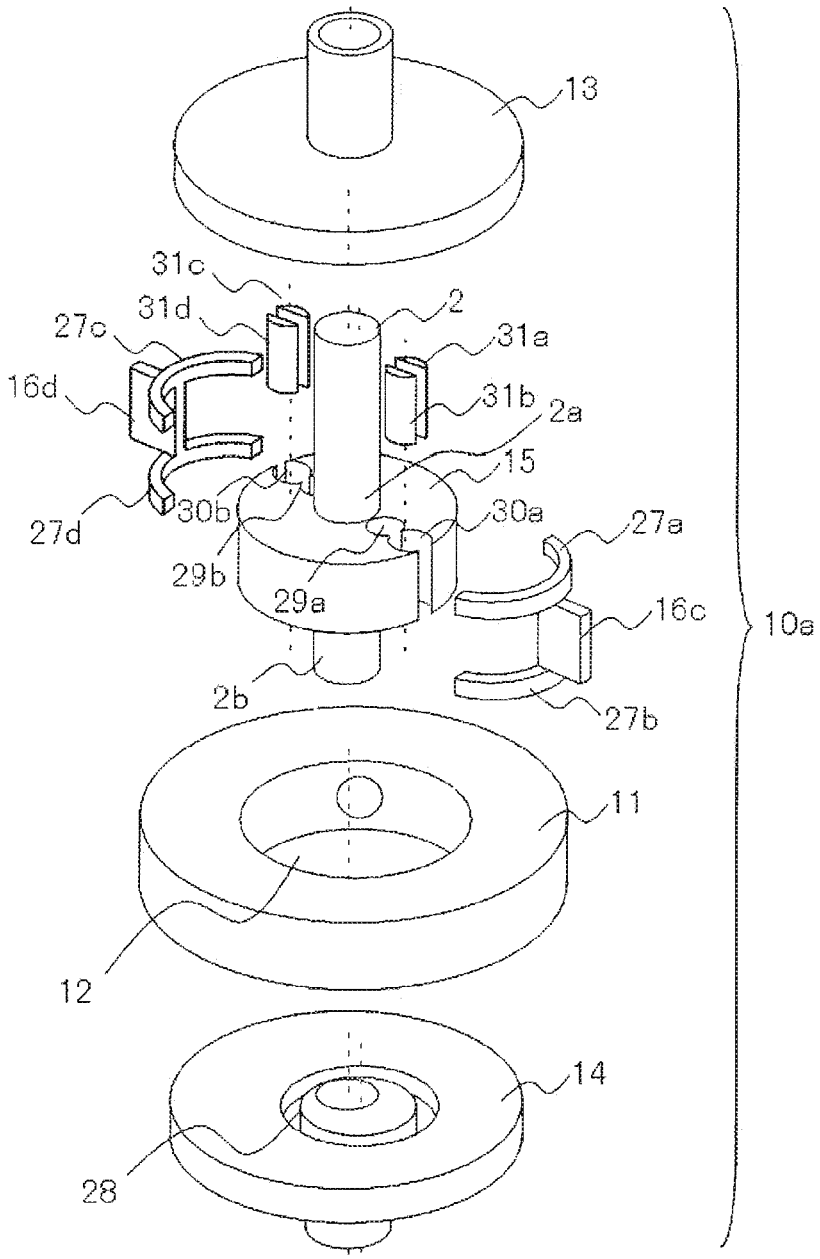
FIG. 18 is an assembly diagram of the compression element portion of a vane rotary compressor according to a third embodiment of the present invention.

FIG. 18 is an assembly diagram of the compression element portion of a compressor 100 in FIG. 1. FIG. 19 is a sectional view after assembling of the compression element portion. Note that the same reference numerals as in FIGS. 2 and 9 denote the same or like components in FIGS. 2 and 9.

As in FIGS. 2 and 9, a compression element 10*a* is constituted by a cylinder 11 having an almost cylindrical inner circumferential surface, upper and lower bearings 13 and 14 which close the two end opening portions of the almost cylindrical inner circumferential surface of the cylinder 11 in the axial direction, a shaft 2 supported by the upper and lower bearings 13 and 14, a roller 15 provided on the shaft 2, and vanes 16*c* and 16*d* provided on the roller 15. The almost cylindrical inner circumferential surface of the cylinder 11 and the upper and lower bearings 13 and 14 form an almost cylindrical cylinder chamber 12, and the roller 15 is accommodated in the cylinder chamber 12, as in FIGS. 2 and 9. In addition, as described above, the cylinder 11, the upper bearing 13, the lower bearing 14, the roller 15, and the vanes 16*c* and 16*d* form an operating chamber in the cylinder chamber 12 as in FIGS. 2 and 9.

The upper and lower bearings 13 and 14 each have an almost T-shaped cross section and a disk-like portion which comes into contact with the cylinder 11.

A vane aligner holding portion (not shown) in a ring groove shape which is concentric with the inner diameter of the cylinder 11 is formed on the end face of the upper bearing 13 which is located on the cylinder 11 side. Vane aligners 27*a* and 27*c* (to be described later) are fitted on the vane aligner holding portion. As in FIGS. 2 and 9, a cylindrical bearing portion is provided on the central portion of the upper bearing 13. This bearing portion rotatably supports a rotating shaft portion 2*a* of the shaft 2.

Likewise, a vane aligner holding portion 28 in a ring groove shape which is concentric with the inner diameter of the cylinder 11 is formed on the end face of the lower bearing 14 which is located on the cylinder 11 side. Vane aligners 27*b* and 27*d* (to be described later) are fitted on the vane aligner holding portion 28. As in FIGS. 2 and 9, a cylindrical bearing portion is provided on the central portion of the lower bearing 14. This bearing portion rotatably supports a rotating shaft portion 2*b* of the shaft 2.

Note that the upper and lower bearings 13 and 14 are fixed to the cylinder 11 with bolts.

As in FIGS. 2 and 9, the roller 15 is fitted on or integrally molded with the shaft 2 in the axial direction so as to be coaxial with the central axis of the shaft 2.

Figure 19:
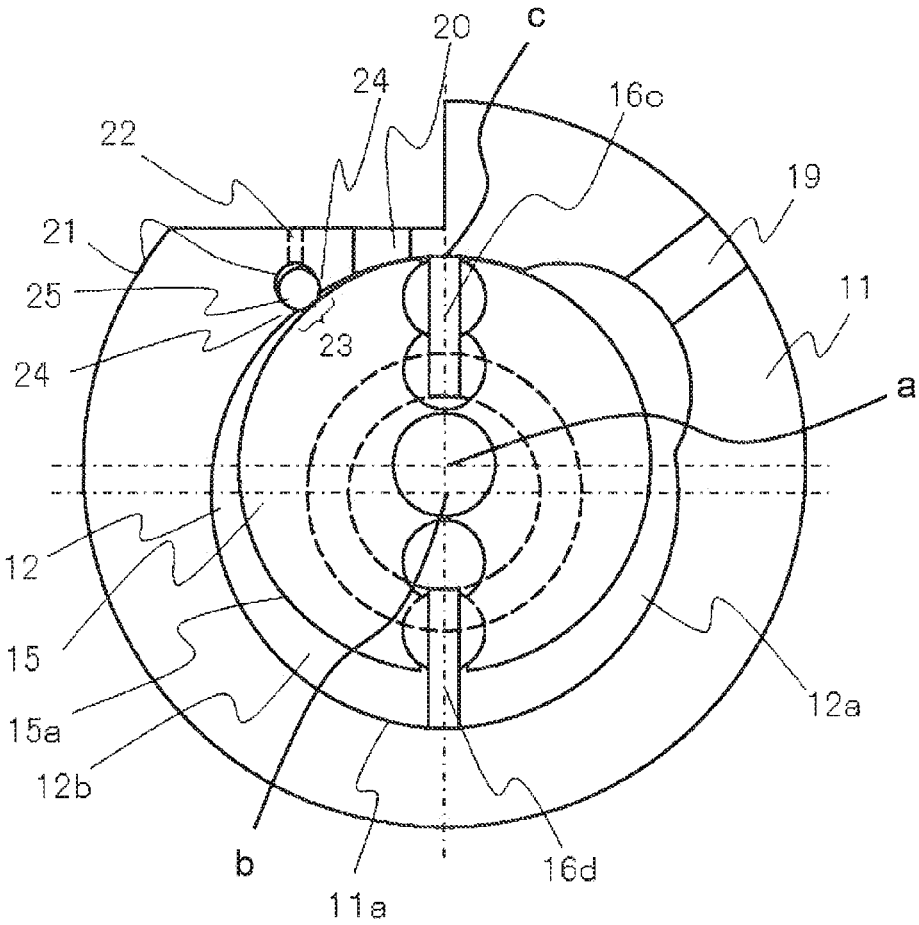
FIG. 19 is a transverse sectional view of the compression element portion of the vane rotary compressor according to the third embodiment of the present invention.

As shown in FIG. 19, as in FIGS. 2 and 9, the rotation center (a) of the roller 15 accommodated in the cylinder chamber 12 is provided at a position offset from the center (b) of the almost cylindrical cylinder chamber 12, and an almost cylindrical outer circumferential surface 15*a* of the roller 15 and a cylinder inner circumferential surface 11*a* have a nearest neighbor point (c). The shaft 2 rotates and slides the roller 15. At the nearest neighbor point (c), the roller outer circumferential surface 15*a* and the cylinder inner circumferential surface 11*a* are not in contact and form a small gap by keeping the distance between them. The small gap is sealed and closed with the refrigerating machine oil 3 supplied to the compression element 10*a*. Note that the roller outer circumferential surface 15*a* and the cylinder inner circumferential surface 11*a* form the cylinder chamber 12 and the operating chamber formed in the cylinder chamber 12.

As shown in FIG. 18, bush holding portions 29*a* and 29*b* and vane clearance portions 30*a* and 30*b*, each having an almost circular cross section and extending through the roller 15 in the axial direction, are formed in the roller 15. The bush holding portion 29*a* communicates with the vane clearance portion 30*a*, and the bush holding portion 29*b* communicates with the vane clearance portion 30*b*. In addition, as shown in FIG. 18, when two vanes 16 are disposed, the bush holding portion 29*a* and the vane clearance portion 30*a* are disposed at positions symmetrical to the bush holding portion 29*b* and the vane clearance portion 30*b*.

The vane 16*c* is inserted in the space with which the bush holding portion 29*a* and the vane clearance portion 30*a* communicate, and the vane 16*d* is inserted in the space with which the bush holding portion 29*b* and the vane clearance portion 30*b* communicate.

The vanes 16*c* and 16*d* each have an almost rectangular parallelepiped plate-like shape. Each vane distal end portion located on the inner circumferential surface side of the cylinder 11 is formed into an arc shape outside. The radius of this arc shape is almost equal to that of the cylinder inner circumferential surface 11*a*, i.e., that of the cylinder chamber 12. The vane aligners 27*a* to 27*d* each formed into a partial ring are provided on the opposite sides of the vanes 16*c* and 16*d* to the cylinder inner circumferential surface 11*a* sides. The vane aligners 27*a* to 27*d* may be integrally formed with the vanes 16*c* and 16*d* or may be welded, bonded, or fitted to them.

Reference numerals 31*a* to 31*d* denote bushes each having an almost semicircular columnar shape. The bushes 31*a* and 32*b* and the bushes 31*c* and 32*d* are formed in pairs. The bushes 31*a* to 31*d* are fitted in the bush holding portions 29*a* and 29*b* of the roller 15. The plate-like vanes 16*c* and 16*d* are respectively held on the inner sides of the bushes 31*a* and 32*b* and the inner sides of the bushes 31*c* and 32*d* so as to freely pivot and be reciprocally movable in almost the normal direction relative to the roller 15.

The vane aligner 27*a* is provided on the surface of the end portion of the vane 16*c* which is located on the opposite side to the cylinder inner circumferential surface 11*a* and is located on the upper bearing 13 side. The vane aligner 27*b* is provided on the surface of the end portion of the vane 16*c* which is located on the opposite side to the cylinder inner circumferential surface 11*a* and is located on the lower bearing 14 side. The vane aligner 27*c* is provided on the surface of the end portion of the vane 16*d* which is located on the opposite side to the cylinder inner circumferential surface 11*a* and is located on the upper bearing 13 side. The vane aligner 27*d* is provided on the surface of the end portion of the vane 16*d* which is located on the opposite side to the cylinder inner circumferential surface 11*a* and is located on the lower bearing 14 side. Due to this arrangement, when the vanes 16*c* and 16*d* are respectively inserted into the space with which the bush holding portion 29*a* of the roller 15 and the vane clearance portion 30*a* communicate and the space with which the bush holding portion 29*b* and the vane clearance portion 30*b* communicate, the vane aligners 27*b* and 27*d* protrude on the end faces of the roller 15 which are located on the upper bearing 13 side and the lower bearing 14 side and are pivotally fitted in the vane aligner holding portions (only the vane aligner holding portion 28 is shown) of the upper and lower bearings 13 and 14.

Due to this arrangement, the vanes 16*c* and 16*d* are restricted by the vane aligner holding portions and the vane aligners 27*a* to 27*d*, which are concentric with the inner diameter of the cylinder inner circumferential surface 11*a*. The vanes 16*c* and 16*d* rotate about the central axis of the cylinder chamber 12 together with the rotation of the roller 15. That is, the distal ends of the vanes 16*c* and 16*d* move along the cylinder inner circumferential surface 11*a*.

In addition, the vanes 16*c* and 16*d* are restricted in the normal direction of the cylinder inner circumferential surface 11*a* by the vane aligners 27*a* to 27*d* and the vane aligner holding portions. The lengths of the vanes 16*c* and 16*d* in the radial direction are set such that the distances from the central axis of the cylinder chamber 12 to the distal ends of the vanes 16*c* and 16*d* which are located on the cylinder inner circumferential surface 11*a* side become shorter than the radius of the cylinder chamber 12.

The distal ends of the vanes 16*c* and 16*d* do not therefore come into contact with the cylinder inner circumferential surface 11*a*, and the vanes 16*c* and 16*d* pivot while keeping a predetermined distance from the cylinder inner circumferential surface 11*a*. That is, a small gap is formed between the distal ends of the vanes 16*c* and 16*d* and the cylinder inner circumferential surface 11*a*. Since the small gap is sealed and closed with the refrigerating machine oil 3 supplied to the compression element 10*a*, the vanes 16*c* and 16*d* can partition the cylinder chamber 12. Since the distal end faces of the vanes 16*c* and 16*d* move substantially at the same angle relative to the cylinder inner circumferential surface 11*a*, the distal end faces of the vanes 16*c* and 16*d* and the cylinder inner circumferential surface 11*a* form a small gap with wide surfaces. This further facilitates sealing with the refrigerating machine oil 3.

On the other hand, since the roller 15 rotates at an eccentric position inside the cylinder chamber 12, the vanes 16*c* and 16*d* move while protruding from and retracting into the space with which the bush holding portion 29*a* of the roller 15 and the vane clearance portion 30*a* communicate and the space with which the bush holding portion 29*b* and the vane clearance portion 30*b* communicate, depending on the directions of the vanes 16*c* and 16*d* relative to the cylinder inner circumferential surface 11*a*. That is, the vanes 16*c* and 16*d* reciprocally slide in the space with which the bush holding portion 29*a* and the vane clearance portion 30*a* communicate and the space with which the bush holding portion 29*b* and the vane clearance portion 30*b* communicate.

Note that the positions and directions of the vanes 16*c* and 16*d* inside the cylinder chamber 12 are determined by the space with which the bush holding portion 29*a* of the roller 15 and the vane clearance portion 30*a* communicate, the space with which the bush holding portion 29*b* and the vane clearance portion 30*b* communicate, the vane aligners 27*a* to 27*d*, and the vane aligner holding portions. For this reason, unlike the first and second embodiments, the third embodiment has no structure which causes the vane back pressure spaces to push out the vanes from the vane grooves. This embodiment therefore has neither a back pressure regulating mechanism nor a vane back pressure flow channel.

A portion around a discharge valve 25 will be described next with reference to FIG. 19.

Like FIGS. 2 and 9, referring to FIG. 19, assuming that the nearest neighbor point between the almost cylindrical outer circumferential surface 15*a* and the almost cylindrical inner circumferential surface 11*a* is defined by 0°, and one clockwise rotation is defined by 360°, the position on the cylinder inner circumferential surface 11*a* at which the vane 16*c* comes into contact with the surface is 0°, and the position on the cylinder inner circumferential surface 11*a* at which the vane 16*d* comes into contact is 180°. When the vane 16*c* is located near 0°, the whole vane 16*c* is accommodated in the roller 15. When the vane 16*d* is located near 180°, the vane 16*d* protrudes to the maximum from the roller 15.

In addition, a suction hole 19 and a discharge hole 20 are provided on the two sides of the nearest neighbor point between the roller outer circumferential surface 15*a* and the cylinder inner circumferential surface 11*a* as in FIGS. 2 and 9.

An intra-cylinder suction space 19*a* is provided at the opening portion of the suction hole 19 which is located on the cylinder inner circumferential surface 11*a* side. The intra-cylinder suction space 19*a* communicates with the opening portion. Unlike FIGS. 2 and 9, however, the intra-cylinder suction space 19*a* is a space extending through the cylinder 11 in the axial direction. Since the vanes 16*c* and 16*d* are not structured to come into contact with the cylinder inner circumferential surface 11*a*, no problem arises even if there is no cylinder inner circumferential surface between the intra-cylinder suction space 19*a* and the cylinder chamber 12 unlike FIGS. 2 and 9.

As in FIG. 2, the cylinder 11 is provided with an almost cylindrical discharge valve groove 21 having an almost circular cross section and extending through the cylinder chamber 12 in the axial direction and a discharge valve back pressure flow channel 22 which makes the high-pressure space outside the cylinder 11 communicate with the discharge valve groove 21. The almost circular columnar discharge valve 25 which is slightly smaller than the discharge valve groove 21 is accommodated in the discharge valve groove 21 so as to freely pivot and be reciprocally movable. The discharge valve groove 21 is provided with a discharge valve groove opening portion 23 which is open to the cylinder chamber 12 and extends throughout the total length of the cylinder inner circumferential surface 11*a* in the axial direction. The discharge valve groove 21 is disposed in the cylinder 11 of the discharge flow channel which makes an operating chamber 12*b* communicate with the discharge hole 20 and along which the refrigerant flows from the operating chamber 12*b* to the discharge hole 20. The discharge valve 25 in the discharge valve groove 21 is pushed to the discharge valve groove opening portion 23 side by the high-pressure refrigerant in the high-pressure space which flows from the discharge valve back pressure flow channel 22, and is locked to a discharge valve groove receiving portion 24 provided in the discharge valve groove opening portion 23 with a portion of the discharge valve 25 protruding to the cylinder chamber 12.

Note that the discharge valve 25 and the discharge valve groove 21 are provided such that the direction of the reciprocal movement of the discharge valve 25 coincides with the normal direction of the almost cylindrical roller outer circumferential surface 15*a* or the normal direction of the almost cylindrical cylinder inner circumferential surface 11*a*.

The discharge valve 25 pushed out to the cylinder chamber 12 partitions the cylinder chamber 12 with the outer circumferential surface of the discharge valve 25 and the roller outer circumferential surface 15*a*. Note however that the outer circumferential surface of the discharge valve 25 and the roller outer circumferential surface 15*a* do not come into contact with each other and keep a predetermined distance from each other. That is, a small gap is formed between the outer circumferential surface of the discharge valve 25 and the roller outer circumferential surface 15*a*. Since the small gap is sealed and closed with the refrigerating machine oil 3 supplied to the compression element 10*a*, the outer circumferential surface of the discharge valve 25 and the roller outer circumferential surface 15*a* can partition the cylinder chamber 12.

Due to this arrangement, as in the first embodiment, the discharge valve 25 is pushed out into the cylinder chamber 12 by the high-pressure refrigerant introduced by the discharge valve back pressure flow channel 22 to close the discharge flow channel along which the refrigerant flows from the operating chamber 12*b* in the cylinder chamber 12 to the discharge hole 20. When the refrigerant pressure in the operating chamber 12*b* becomes a predetermined pressure, the discharge valve 25 is pushed back to the discharge valve groove 21 to open the discharge flow channel along which the refrigerant flows from the operating chamber 12*b* to the discharge hole 20.

The operation of this arrangement will be described next. FIGS. 20A to 20D show the process from the suction to the discharge of the compression element 10*a*.

Figure 20:
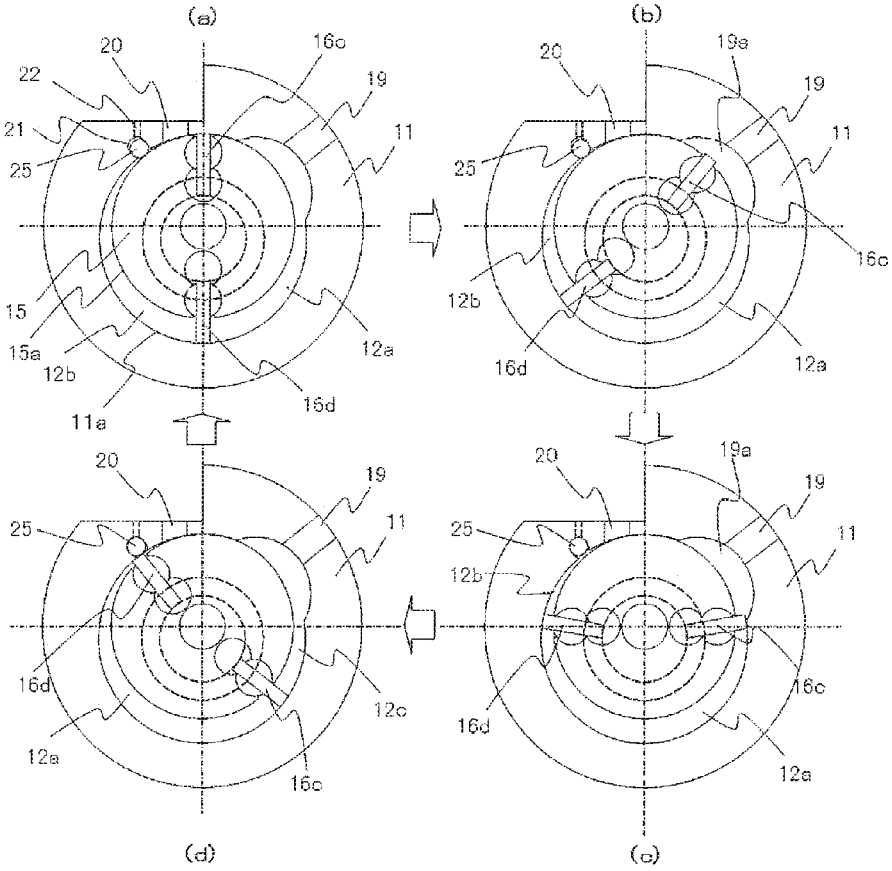
FIGS. 20A to 20D are views showing the compression process of the vane rotary compressor according to the third embodiment of the present invention.

FIG. 20A shows the step in which an operating chamber 12*a* located on the suction hole 19 side communicates with the suction hole 19 to suck the refrigerant. At this time, the operating chamber 12*a* is formed by being partitioned by the cylinder inner circumferential surface 11*a*, the roller outer circumferential surface 15*a*, the vane 16*d*, and the nearest neighbor point between the roller outer circumferential surface 15*a* and the cylinder inner circumferential surface 11*a*.

FIG. 20B shows a state in which the roller 15 has rotated clockwise from the state in FIG. 20A. Since the vane 16*c* moves at a predetermined distance from the cylinder inner circumferential surface 11*a*, and hence moves at a position away from the suction hole 19. Therefore, the operating chamber 12*a* keeps communicating with the suction hole 19 through the intra-cylinder suction space 19*a* and keeps performing sucking operation regardless of the position of the vane 16*c*.

FIG. 20C shows a state in which the roller 15 has rotated through about 90°, and the vane 16*c* has closed the operating chamber 12*a* and the intra-cylinder suction space 19*a*. That is, the operating chamber 12*a* is formed by the cylinder inner circumferential surface 11*a*, the roller outer circumferential surface 15*a*, and the vanes 16*c* and 16*d*. The operating chamber 12*a* and the suction hole 19 stop communicating with each other, and the processing of suction finishes. The process of compression starts from this state.

FIG. 20D shows a state in which the vane 16*d* is in contact with the discharge valve 25. FIG. 20A shows a state in which the vane 16*d* has moved to the discharge hole 20 side. Subsequently, the operating chamber 12*a* in FIG. 20D corresponds to the operating chamber 12*b* in FIG. 20A. Likewise, the vanes 16*d* and 16*c* in FIG. 20D respectively correspond to the vanes 16*c* and 16*d* in FIG. 20A. The following description will use them.

When the vane 16*c* moves to the discharge hole 20 side of the discharge valve 25, the operating chamber 12*b* is formed by the cylinder inner circumferential surface 11*a*, the roller outer circumferential surface 15*a*, the vane 16*d*, and the discharge valve 25. As the vane 16*c* further moves to the positions in FIGS. 20B and 20C, the compression in the operating chamber 12*b* progresses, and the discharge valve 25 opens, thus starting discharge operation.

The opening/closing operation of the discharge valve 25 is the same as that in the first embodiment. That is, the discharge valve 25 is opened and closed by external forces acting on them. More specifically, the discharge valve 25 is opened and closed by a force F1*x* with which the high-pressure refrigerant introduced from the discharge valve back pressure flow channel 22 pushes the discharge valve 25 from the discharge valve groove 21 side to the cylinder chamber 12 side, a force F2*x* pushing the discharge valve 25 from the cylinder chamber 12 side to the discharge valve groove 21 side, and a force F3*x* pushing the discharge valve 25 from the cylinder chamber 12 side to the discharge valve groove 21 side. That is, if $F1x>(F2x+F3x)$, the discharge flow channel along which the refrigerant flows from the operating chamber 12*b* to the discharge hole 20 closes. If $F1x<(F2x+F3x)$, the discharge flow channel along which the refrigerant flows from the operating chamber 12*b* to the discharge hole 20 opens.

By means of the above process, as the discharge valve 25 closes and opens the discharge flow channel along which the refrigerant flows from the operating chamber 12*b* to the discharge hole 20, the compression element 10*a* performs discharge operation, and the compressor 100 causes the compression element 10 to repeat the suction, compression, and discharge processes to circulate the refrigerant in the refrigerant circuit.

In the same manner as in the first embodiment, providing the discharge valve 25 on the discharge flow channel along which the refrigerant flows from the operating chamber 12*b* to the discharge hole 20 can prevent the discharge hole 20 from becoming a dead volume after discharge operation. This makes it possible to prevent the high-pressure refrigerant from flowing back from the discharge hole 20 to the operating chamber 12*b* by closing the discharge flow channel between the discharge hole 20 and the operating chamber 12*b* which performs discharge operation next. Then, it is possible to prevent a re-expansion loss caused at this time, and further suppress a deterioration in efficiency due to an increase in input.

In addition, the discharge hole 20 keeps communicating the high-pressure space, and hence can prevent the high-pressure refrigerant which cannot be discharged to the high-pressure space from staying in the discharge hole 20.

In the first embodiment, since each vane comes into contact with the cylinder inner circumferential surface 11*a*, the vane comes into contact with and slides on the discharge valve 25, the discharge valve groove opening portion 23, and the discharge valve groove receiving portion 24. For this reason, external forces act on portions in relatively thin shapes like the discharge valve groove receiving portion 24. This requires some consideration in terms of strength. In contrast to this, since the vanes 16*c* and 16*d* are noncontact vanes which each do not come into contact with the cylinder inner circumferential surface 11*a*, the vanes do not come into contact with the discharge valve groove opening portion 23 and the discharge valve groove receiving portion 24, which are parts of the inner circumferential surface of the cylinder 11, and hence no problem arises in terms of the strength of portions in thin shapes. For example, there is no need to provide a structure obtained by expanding the discharge valve groove opening portion 23 and the discharge valve groove receiving portion 24 to the outer circumferential side relative to the cylinder inner circumferential surface 11*a* so as to prevent the vanes 16*c* and 16*d* from coming into contact with them.

The discharge valve 25 is also a noncontact type vane which does not come into contact with the outer circumferential surface 15*a* of the roller 15. When the vanes 16*c* and 16*d* pass through the discharge valve 25, they can pass through the discharge valve 25 without touching it depending on conditions such as the speed. Even if they come into contact with each other, since the discharge valve pivots freely, the frictional resistance is small. Therefore, the sliding loss between the vanes 16*c* and 16*d* and the discharge valve 25 is small.

As described above, it is possible to obtain a compressor having a configuration in which a discharge valve is disposed on the discharge flow channel along which the refrigerant flows from the discharge hole upstream side in the vicinity of the discharge hole, i.e., from the operating chamber, to the discharge hole, the compressor suppressing a deterioration in the efficiency thereof due to an increase in compressor input, which occurs when opening/closing of the discharge flow channel makes the high-pressure refrigerant staying in the internal volume of the discharge hole flow back to the operating chamber and the flowback refrigerant is re-expanded and re-compressed, thereby causing a re-expansion loss.

It is also possible to prevent the high-pressure refrigerant which cannot be discharged to the high-pressure space from staying in the discharge hole after discharge operation and to prevent a deterioration in volume efficiency.

In addition, use of noncontact type vanes and discharge valve can prevent the vanes and the discharge valve from coming into contact with each other. Even if they come into contact with each other, the frictional resistance is reduced due to the pivoting of the discharge valve, so that a compressor which protects the thin portions of the cylinder inner circumferential surface from being damaged and reduces a sliding loss, can be obtained.

According to the conventional countermeasure against a dead volume, since the discharge valve is provided in the discharge hole, when the discharge valve opens, the discharge valve interferes with the refrigerant flowing along the flow channel, resulting in an increase in flow channel resistance. In contrast to this, according to this embodiment, since the discharge valve is pushed back to the discharge valve groove provided on the cylinder side and opens, the discharge valve does not interfere with the high-pressure refrigerant discharged from the operating chamber to the high-pressure space even if the vanes are noncontact type vanes, thus preventing a large pressure loss at the time of discharge operation.

It is preferable to use a refrigerant having a low operating pressure, with which the force applied from the operating chamber to the vane is small. In addition, since the discharge valve groove receiving portion has a relatively thin shape, the force acting on the discharge valve groove receiving portion is preferably small. It is therefore preferable to use a refrigerant having a low operating pressure. For example, a refrigerant having a standard boiling point of not less than −45° C. is preferably used. More specifically, a refrigerant like R600a (isobutane), R600 (butane), R290 (propane), R134a, R152a, R161, R407C, R1234yf, or R1234ze can be used without raising any problems in terms of the strength of the vane and discharge valve groove receiving portion, even if the vanes are noncontact type vanes.

In addition, use of one or more vanes can form an operating chamber, and use of a plurality of vanes can partition the operating chamber into a plurality of operating chambers. It is therefore possible to increase the number of operating chambers and increase the displacement while achieving space saving without increasing the size of the compression element portion.

It is therefore possible to obtain a compressor which can increase the displacement while achieving space saving even by using a refrigerant having a low operating pressure.

In addition, use of a lightweight metal material such as aluminum or titanium or an alloy material such as an aluminum base alloy or titanium base alloy for a discharge valve will achieve a further reduction in weight. This can further reduce the inertia force and improve the responsiveness of reciprocal movement of the discharge valve inside the discharge valve groove.

Furthermore, it is also possible to regulate opening/closing conditions by changing the mass of the discharge valve other than the responsiveness.

Moreover, since the discharge valve reciprocally moves inside the discharge valve groove, it is possible to reduce abrasion, make it difficult to produce abrasion powder, and prolong the service life of the compressor by forming an abrasion-resistant coating on the surface of at least one of the discharge valve and the discharge valve groove.

According to the conventional countermeasures against a dead volume, since the range of movement of the discharge valve is large, an operation delay occurs in the discharge valve. In contrast to this, since the range of movement of the discharge valve relative to the discharge valve groove is narrowed to improve the responsiveness of reciprocal movement inside the discharge valve groove, it is possible to close the flow channel without any operation delay after discharge operation. This can inhibit the high-pressure refrigerant from flowing back from the high-pressure space to the operating chamber, which occurs due to an operation delay in the discharge valve.

Although another discharge valve is provided on the cylinder outer surface side of the discharge hole because of an operation delay in the discharge valve, there is no need to provide another discharge valve and locate discharge valves at two positions. This makes it possible to form a compressor including an inexpensive compression element portion while achieving space saving.

Figure 21:
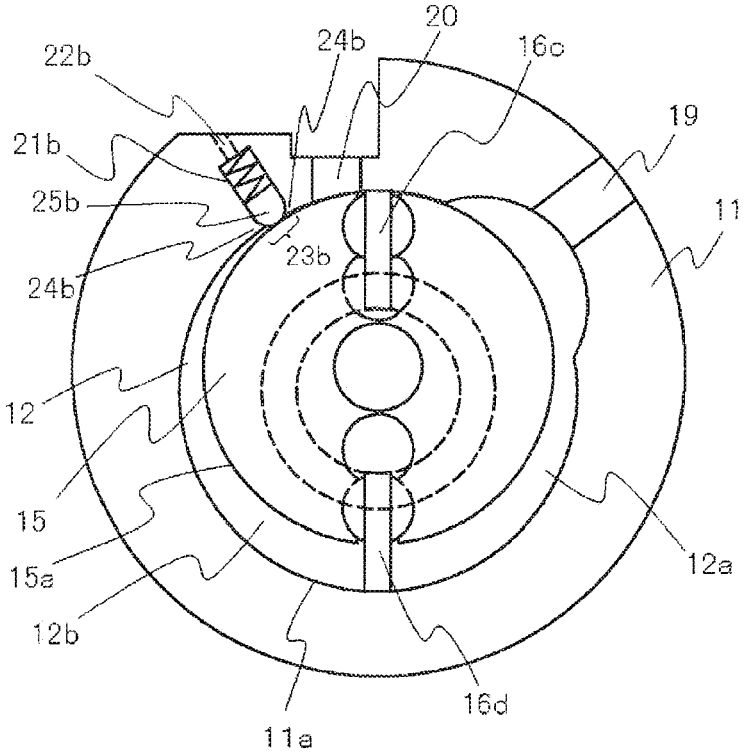
FIG. 21 is an explanatory diagram of a form in which the discharge valve structure of the vane rotary compressor according to the third embodiment of the present invention is changed.

As shown in FIG. 21, in the same manner as in the second embodiment, the form shown in FIG. 18 may be provided with a rectangular parallelepiped discharge valve 25*b* and a spring 26 as biasing means. Providing the biasing means makes it possible to close the discharge flow channel even if the refrigerant pressure in the high-pressure space is not sufficiently high. In addition, the biasing means further improve the responsiveness of the reciprocal movement of the discharge valve inside the discharge valve groove, thereby allowing the discharge flow channel to be closed after discharge operation without any operation delay.

Figure 22:
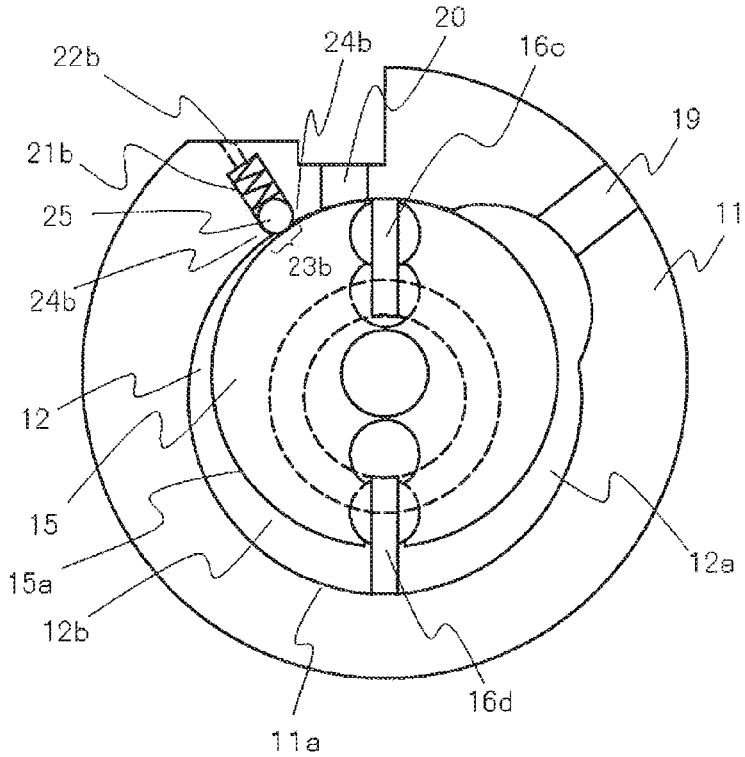
FIG. 22 is an explanatory diagram of a form in which the discharge valve structure of the vane rotary compressor according to the third embodiment of the present invention is changed.

In addition, as shown in FIG. 22, a spring 26 may be provided for a circular columnar or cylindrical discharge valve 25. Due to this arrangement, even if the refrigerant pressure in the high-pressure space is not sufficiently high, it is possible to close the discharge flow channel. In addition, since the discharge valve 25 is in the state of coming in contact with the spring 26 with a small contact area, the discharge valve 25 pivots freely. Even if, therefore, the discharge valve 25 comes into contact with vanes 16*c* and 16*d*, the discharge valve 25 pivots, thereby obtaining an effect of reducing friction.

Figure 23:
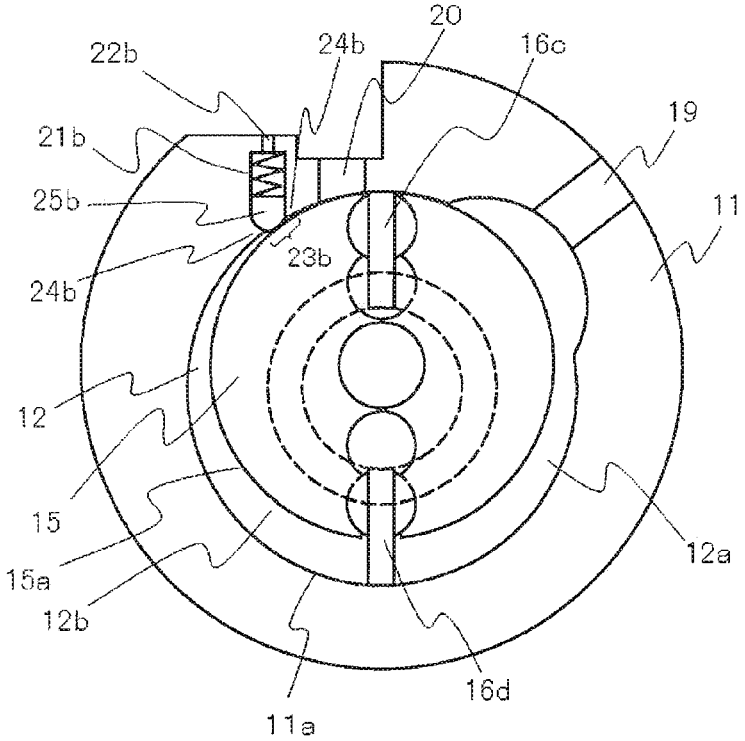
FIG. 23 is an explanatory diagram of a form in which the discharge valve structure of the vane rotary compressor according to the third embodiment of the present invention is changed.
Figure 24:
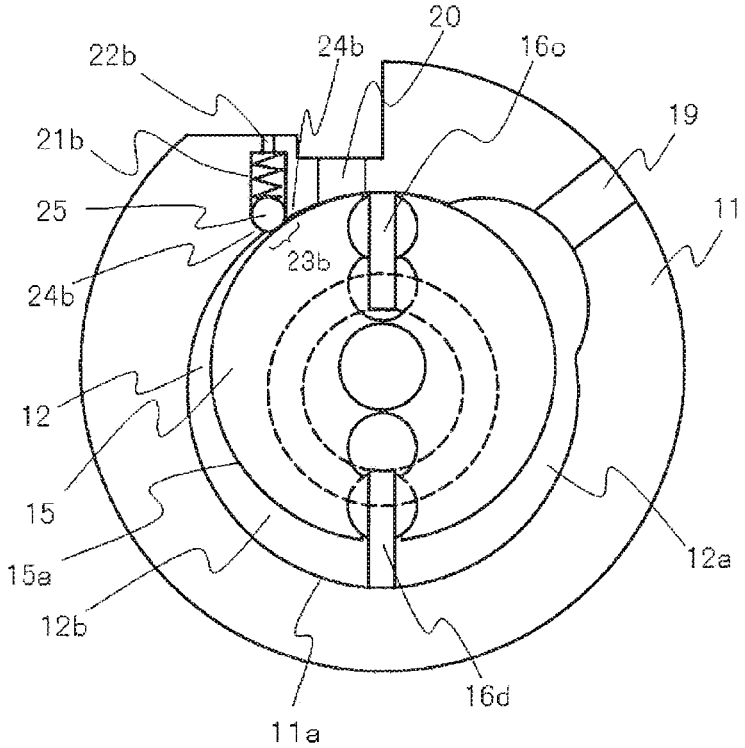
FIG. 24 is an explanatory diagram of a form in which the discharge valve structure of the vane rotary compressor according to the third embodiment of the present invention is changed.

Furthermore, it is possible to regulate opening/closing conditions for the discharge valve by changing the direction of the reciprocal movement of the discharge valve. For example, as shown in FIGS. 23 and 24, if the direction of the reciprocal movement of the discharge valve 25 or 25*b* is inclined to the discharge hole 20 side relative to the normal direction of the almost cylindrical roller outer circumferential surface 15*a*, a component, of the resultant force of forces pushing the discharge valve 25 or 25*b* from the cylinder chamber 12 side to the discharge valve groove 21*b* side, which acts on the operating chamber 12*b* side becomes large. As a consequence, the force acting from the operating chamber 12*b* side, i.e., the refrigerant force in the operating chamber 12*b*, acts as a main force to open and close the discharge valve 25 or 25*b*. That is, it is possible to flexibly regulate pressure conditions for the refrigerant in the high-pressure space, which opens and closes the discharge valve 25 or 25*b*, and the operating chamber by regulating the direction of the reciprocal movement of the discharge valve 25 or 25*b* so as to have a predetermined inclination in the circumferential direction relative to the normal direction of the roller outer circumferential surface 15*a* or cylinder inner circumferential surface 11*a*.

In addition, FIGS. 21 to 24 show the states in which the spring 26 and the discharge valve 25 or 25*b* are brought into contact with each other and are always pushed toward the discharge valve groove opening portion 23 or 23*b*. However, when the discharge valve 25 or 25*b* is pushed out from the discharge valve groove opening portion 23 or 23*b* to the cylinder chamber 12, the spring 26 need not always be in contact with the discharge valve 25 or 25*b*. That is, they need not be in contact with each other.

That is, one end face of the spring 26 is fixed to the opposite surface of the discharge valve groove 21*b* to the discharge valve groove opening portion 23 or 23*b*, and the other end face comes into contact with the discharge valve 25 or 25*b* when the discharge valve 25 or 25*b* is pushed back into the discharge valve groove 21*b*, and separates from the discharge valve 25 or 25*b* when a portion of the discharge valve 25 or 25*b* is pushed out to the cylinder chamber 12 by a predetermined amount or more.

Due to this arrangement, even if the refrigerant pressure in the high-pressure space is not sufficiently high, it is possible to close the discharge flow channel along which the refrigerant flows from the operating chamber to the discharge hole. In addition, since the force of the spring 26 is not applied when the discharge valve 25 or 25*b* is pushed out to the discharge valve groove receiving portion 24*b*, there is no need to make the discharge valve groove receiving portion 24*b* have an extra strength, thereby obtaining a compressor having higher reliability.

In addition, if the discharge valve has a columnar shape or cylindrical shape, the spring 26 does not come into contact with the discharge valve 25 to allow the discharge valve 25 to pivot more freely, thereby obtaining a high-efficiency compressor having small friction and sliding losses.

REFERENCE SIGNS LIST

1 . . . closed vessel
1*a* . . . upper vessel
1*b* . . . lower vessel
2 . . . shaft
2*a*, 2*b* . . . rotating shaft
3 . . . refrigerating machine oil
4 . . . suction pipe
5 . . . discharge pipe
10, 10*a* . . . compression element
11 . . . cylinder
11*a* . . . cylinder inner circumferential surface
12 . . . cylinder chamber
12*a*, 12*b*, 12*c* . . . operating chamber
13 . . . upper bearing
14 . . . lower bearing
15 . . . roller
15*a* . . . roller outer circumferential surface
16*a*, 16*b*, 16*c*, 16*d* . . . vane
17*a*, 17*b* . . . vane groove
18*a*, 18*b* . . . vane back pressure space
19 . . . suction hole
19*a* . . . intra-cylinder suction space
19*b* . . . inner circumferential surface
20 . . . discharge hole
21, 21*b* . . . discharge valve groove
22, 22*b* . . . discharge valve back pressure flow channel
23, 23*b* . . . discharge valve groove opening portion
24, 24*b* . . . discharge valve groove receiving portion
25, 25*a*, 25*b* . . . discharge valve
26 . . . spring
27*a*, 27*b*, 27*c*, 27*d* . . . vane aligner
28 . . . vane aligner holding portion
29*a*, 29*b* . . . bush holding portion
30*a*, 30*b* . . . vane clearance portion
31*a*, 31*b*, 31*c*, 31*d* . . . bush
40 . . . motor element
41 . . . stator
42 . . . rotor
43 . . . stator core
44 . . . insulating member
45 . . . coil
46 . . . lead wire
47 . . . glass terminal
48 . . . rotor core
49 . . . air gap
100 . . . compressor
101 . . . accumulator
201 . . . condenser
202 . . . pressure reducer
203 . . . evaporator

What is claimed is:

1. A vane rotary compressor comprising a compression element which sucks a refrigerant from a low-pressure space, compresses the refrigerant, and discharges the refrigerant to a high-pressure space, the compression element comprising a cylinder which has an internal space formed by a substantially cylindrical inner circumferential surface, a roller having a substantially cylindrical outer circumferential surface which is accommodated in the internal space and makes rotary motion in the internal space, a shaft which includes the roller and transfers a rotational force to the roller, two bearings which support the shaft and close opening portions of two ends of the internal space of the cylinder, a plate-like vane which is provided on the roller, is made to protrude from the outer circumferential surface of the roller to the inner circumferential surface of the cylinder, and partitions a space formed by the outer circumferential surface of the roller, the inner circumferential surface of the cylinder, and the bearings into a plurality of operating chambers, a suction hole which is provided in the cylinder and sucks a refrigerant from the low-pressure space to the operating chamber, a discharge hole which is provided in the cylinder and discharges the refrigerant from the operating chamber to the high-pressure space, a discharge flow channel to which the discharge hole is open and which is formed by the outer circumferential surface of the roller, the inner circumferential surface of the cylinder, and the bearings and communicates with the operating chamber, a discharge valve groove which is provided in the cylinder and has an opening portion in the inner circumferential surface of the cylinder which forms the discharge flow channel, a discharge valve back pressure flow channel which makes the discharge valve groove communicate with the high-pressure space and introduces a high-pressure refrigerant from the high-pressure space, and a discharge valve which is accommodated in the discharge valve groove so as to be reciprocally slidable, is pushed out from the opening portion of the discharge valve groove to the outer circumferential surface of the roller by the high-pressure refrigerant when a refrigerant pressure in the operating chamber is lower than a pressure of the high-pressure refrigerant, and is pushed back into the discharge valve groove by the refrigerant pressure in the operating chamber when the refrigerant pressure in the operating chamber is higher than the pressure of the high-pressure refrigerant, wherein the discharge flow channel is closed by the outer circumferential surface of the discharge valve pushed out from the opening portion of the discharge valve groove and the outer circumferential surface of the roller, and is opened when the discharge valve is pushed back to the discharge valve groove.

2. The vane rotary compressor of claim 1, wherein the discharge valve has one of a substantially circular columnar shape and a substantially cylindrical shape.

3. The vane rotary compressor of claim 2, wherein the discharge valve includes biasing means between the discharge valve and the discharge valve groove and is pushed out from the opening portion of the discharge valve groove to the outer circumferential surface of the roller by the biasing means.

4. The vane rotary compressor of claim 3, wherein the biasing means of the discharge valve is configured such that when the discharge flow channel is closed by not less than a predetermined sectional area, biasing force of the biasing means becomes zero.

5. The vane rotary compressor of claim 1, wherein the discharge valve has a rectangular parallelepiped shape with a distal end located on the outer circumferential surface side of the roller and having a substantially semicircular columnar shape, includes biasing means between the discharge valve and the discharge valve groove, and is pushed out from the opening portion of the discharge valve groove to the outer circumferential surface of the roller by the biasing means.

6. The vane rotary compressor of claim 1, wherein the discharge valve has a predetermined gap between an outer circumferential surface of the discharge valve and the outer circumferential surface of the roller when the discharge valve is pushed out from the opening portion of the discharge valve groove.

7. The vane rotary compressor of claim 1, wherein the vane moves along the inner circumferential surface of the cylinder while a distal end of the vane which is located on the inner circumferential surface of the cylinder is in contact with the inner circumferential surface of the cylinder.

8. The vane rotary compressor of claim 1, wherein the vane moves along the inner circumferential surface of the cylinder while a distal end of the vane located on the inner circumferential surface side of the cylinder keeps a predetermined gap from the inner circumferential surface of the cylinder.

9. The vane rotary compressor of claim 1, wherein the discharge valve and the discharge valve groove are provided such that a reciprocal direction of the discharge valve coincides with one of a normal direction of the outer circumferential surface of the roller and a normal direction of the inner circumferential surface of the cylinder.

10. The vane rotary compressor of claim 1, wherein the discharge valve and the discharge valve groove are provided such that a reciprocal direction of the discharge valve has a predetermined inclination in a circumferential direction relative to one of a normal direction of the outer circumferential surface of the roller and a normal direction of the inner circumferential surface of the cylinder, and a pressure condition for the refrigerant which allows an open/close operation of the discharge valve is regulated in accordance with the inclination.

11. The vane rotary compressor of claim 1, wherein the discharge valve comprises one material selected from the group consisting of lightweight metal materials including aluminum and titanium and alloy materials including an aluminum base alloy and a titanium base alloy.

12. The vane rotary compressor of claim 1, wherein an abrasion-resistant coating is formed on at least one of a surface of the discharge valve and an inner circumferential surface of the discharge valve groove.

13. The vane rotary compressor of claim 1, wherein the refrigerant comprises a refrigerant having a standard boiling point of not less than −45° C.

* * * * *